US011045825B2

(12) United States Patent
Russell et al.

(10) Patent No.: US 11,045,825 B2
(45) Date of Patent: Jun. 29, 2021

(54) SCANNER NOZZLE ARRAY, SHOWERHEAD ASSEMBLY AND METHOD

(71) Applicant: dlhBOWLES, Inc., Canton, OH (US)

(72) Inventors: Gregory A. Russell, Catonsville, MD (US); Steve Crockett, Columbia, MD (US)

(73) Assignee: DLHBOWLES, INC., Canton, OH (US)

( * ) Notice: Subject to any disclaimer, the term of this patent is extended or adjusted under 35 U.S.C. 154(b) by 0 days.

(21) Appl. No.: 15/775,031

(22) PCT Filed: Nov. 23, 2016

(86) PCT No.: PCT/US2016/063608

§ 371 (c)(1),
(2) Date: May 10, 2018

(87) PCT Pub. No.: WO2017/091732

PCT Pub. Date: Jun. 1, 2017

(65) Prior Publication Data

US 2018/0318855 A1 Nov. 8, 2018

Related U.S. Application Data

(60) Provisional application No. 62/258,991, filed on Nov. 23, 2015.

(51) Int. Cl.
*B05B 3/16* (2006.01)
*B05B 1/18* (2006.01)

(52) U.S. Cl.
CPC ..... *B05B 3/16* (2013.01); *B05B 1/18* (2013.01); *B05B 1/185* (2013.01)

(58) Field of Classification Search
CPC .... B05B 3/16; B05B 1/08; B05B 1/18; B05B 1/185

(Continued)

(56) References Cited

U.S. PATENT DOCUMENTS 4,184,636 A 1/1980 Bauer
5,213,267 A * 5/1993 Heimann ..... B05B 1/1681 239/446

(Continued)

OTHER PUBLICATIONS

International Search Report and Written Opinion dated Apr. 17, 2017; International Patent Application No. PCT/US2016/063608 filed on Nov. 23, 2016. ISP/US.

*Primary Examiner* — Joseph A Greenlund
(74) *Attorney, Agent, or Firm* — McDonald Hopkins LLC

(57) ABSTRACT

A new scanner fluidic oscillator is used in an economically manufactured fluidic showerhead or nozzle assembly 50, 198, 250, 400 which aims oscillating sprays from multiple scanner fluidics to spread water uniformly over a preselected coverage area. The scanner fluidics and showerhead of the present invention provide a pleasing spray pattern, droplet size, droplet velocity, and temperature uniformity at very low flow rates (i.e., 2 gpm or less) for showering. The scanner fluidics are provided in a plurality of distinct configurations for generating individually tailored scanning sprays having a selected scanning spray characteristics. The showerhead's front plate (e.g., 56, 200, 270, 454) is configured to support and aim the fluidic oscillators, optionally with indexing slots 802 configured to receive corresponding angular indexing tabs 800 on the fluidic oscillator inserts to orient and aim the spray from each fluidic oscillator (e.g., 172, 220,282, 530).

8 Claims, 18 Drawing Sheets

(58) Field of Classification Search
USPC ..... 239/242, 589.1
See application file for complete search history.

(56) References Cited

U.S. PATENT DOCUMENTS

| | | | | |
|---|---|---|---|---|
| 5,246,301 | A | 9/1993 | Hirasawa | |
| 5,445,516 | A * | 8/1995 | Stouffer | F23D 14/28 239/11 |
| 6,328,228 | B1 * | 12/2001 | Bossini | B05B 1/1645 239/390 |
| 6,592,058 | B2 * | 7/2003 | Kassanits | B05B 1/04 239/597 |
| 6,938,835 | B1 * | 9/2005 | Stouffer | B05B 1/08 137/808 |
| 8,205,812 | B2 | 6/2012 | Hester | |
| 2002/0109023 | A1 * | 8/2002 | Thomas | B05B 15/528 239/562 |
| 2006/0043110 | A1 * | 3/2006 | Miyauchi | B05B 1/08 222/129.1 |
| 2006/0043214 | A1 * | 3/2006 | Macan | B05B 3/049 239/222.11 |
| 2007/0246577 | A1 * | 10/2007 | Leber | B05B 15/652 239/589 |
| 2009/0114739 | A1 * | 5/2009 | Furseth | E03C 1/0408 239/243 |
| 2010/0072307 | A1 * | 3/2010 | Hester | B05B 1/14 239/589.1 |
| 2011/0061692 | A1 * | 3/2011 | Gopalan | B60S 1/52 134/169 R |
| 2011/0233301 | A1 * | 9/2011 | Gopalan | B05B 1/08 239/101 |
| 2013/0299608 | A1 * | 11/2013 | Spangler | B05B 1/08 239/444 |
| 2016/0059240 | A1 * | 3/2016 | Rexach | B05B 1/185 239/562 |
| 2016/0082447 | A1 * | 3/2016 | Gong | B05B 1/08 239/461 |
| 2016/0318045 | A1 * | 11/2016 | Huffington | B05B 1/185 |
| 2018/0318855 | A1 * | 11/2018 | Russell | B05B 1/18 |
| 2019/0060920 | A1 * | 2/2019 | Currie | B05B 1/08 |
| 2019/0201918 | A1 * | 7/2019 | Russell | B05B 1/08 |

* cited by examiner

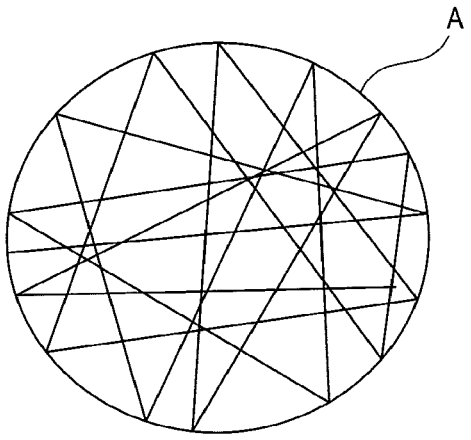
FIG.5
(PriorArt)

SCANNER NOZZLE ARRAY, SHOWERHEAD ASSEMBLY AND METHOD

REFERENCE TO RELATED APPLICATIONS

This application is a 35 U.S.C. 371 national stage filing and claims priority to and the benefit of International Application No PCT/US2016/063608 filed on Nov. 23, 2016, which claims the priority benefit of U.S. provisional patent application No. 62/258,991, filed on Nov. 23, 2015, and entitled "SCANNER NOZZLE ARRAY AND SHOWERHEAD ASSEMBLY". This application is also related to commonly owned U.S. Pat. Nos. 6,938,835, 6,948,244, 7,111,800, 7,677,480, and 8,205,812, which cover a prior embodiment of the commonly-owned scanner fluidic oscillator, multiple fluidic enclosures, and methods of integrating fluidic geometry (exit geometry) into the housing of a fluidic device. The entire disclosures of all of the foregoing applications and patents are hereby incorporated herein by reference.

BACKGROUND

Field of the Invention

This invention relates to fluid handling processes and apparatus. More particularly, this invention relates to new methods and apparatus for fabricating fluidic oscillators or inserts and showerheads and other nozzle assemblies to improve their performance.

Description of the Related Art

Standard jet-type shower heads do not provide pleasing spray pattern, uniform droplet size, uniform droplet velocity, and temperature uniformity at very low flow rates (e.g., 2 gpm or less) for showering. Any fluidic showerhead can, in general, provide improvements over the prior art traditional showerheads. Most fluidic-equipped showerheads have very few spray generating openings and are, therefore, initially considered inferior by un-knowing consumers at stores where they cannot spray the showerhead before purchasing. Prior fluidic showerheads are also tricky to manufacture because of the difficulty in sealing of the fluidic passages. Prior fluidic showerheads also tend to be more expensive than conventional jet showers because of the number of component fluidics. A useful background and introduction to the nomenclature needed to understand this invention is provided in U.S. Pat. Nos. 6,938,835, 6,948,244, 7,111,800, 7,677,480, and 8,205,812, which patents are commonly-owned by the owner of the present application and cover a prior embodiment of the commonly-owned scanner fluidic oscillator, multiple fluidic enclosures, and methods of integrating fluidic geometry (exit geometry) into the housing of a fluidic device.

Fluidic inserts or oscillators are well known for their ability to provide a wide range of distinctive liquid sprays by cyclically deflecting, without the use of mechanical moving parts, the flow of a liquid jet. The distinctiveness of these sprays is due to the fact that they are characterized by being oscillatory in nature, as compared to the relatively steady state flows that are emitted from standard spray or shear nozzles.

U.S. Pat. No. 4,052,002 (Stouffer & Bray) shows in its FIGS. 5-7 some of the typical liquid droplet spray patterns that can be produced by fluidic oscillators (wherein the droplet patterns illustrated represent the droplets produced during one complete cycle of the cyclically deflected liquid jet). It shows what can be considered to be the essentially temporally varying, planar flow pattern of a liquid jet or spray that issues from the oscillator into a surrounding gaseous environment and breaks into droplets which are distributed transversely (i.e., in the assumed y-direction) to the jet's assumed, generally x-direction of flow.

Such spray patterns may be described by the definable characteristics of their droplets (e.g., the volume flow rate of the spray, the spray's area of coverage, the spatial distribution of droplets in planes perpendicular to the direction of flow of the spray and at various distances in front of the oscillator's outlet, the average droplet velocities, the average size of the droplets, and the frequency at which the droplets impact on an obstacle in the path of the spray).

A fluidic insert is generally thought of as a thin, rectangular member that is molded or fabricated from plastic and has an especially-designed, liquid flow channel (or a means for inducing oscillations in the liquid that flows through the channel) fabricated into either its broader top or bottom surface, and sometimes both (assuming that this fluidic insert is of the standard type that is to be inserted into the cavity of a housing whose inner walls are configured to form a liquid-tight seal around the insert and form an outside wall for the insert's boundary surface/s which contain the especially designed flow channels). Pressurized liquid enters such an insert and is sprayed from it. Appropriate selection of the arrangement of the oscillator's flow channel and its dimensions are seen, at a specified flow rate, to control the properties of the sprayed oscillating liquid droplets.

Although it is more practical from a manufacturing standpoint to construct these inserts as thin rectangular members with flow channels in their top or bottom surfaces, it should be recognized that they can be constructed so that their liquid flow channels are placed practically anywhere (e.g., on a plane that passes though the member's center) within the member's body; in such instances the insert would have a clearly defined channel inlet and outlet. For example, see U.S. Pat. No. 5,820,034 (Hess) and its FIGS. 3-4 which show a two-part, fluidic insert whose exterior surface is cylindrical so that this insert can be fitted into a similarly shaped housing.

Additionally, it should be recognized that these flow channels need not be of a uniform depth. For example, see U.S. Pat. No. 4,463,904 (Bray), U.S. Pat. No. 4,645,126 (Bray) and RE38,013 (Stouffer) for fluidic oscillators in which the bottom surfaces of these channels are discretely and uniformly sloped so as to impact the ways in which the sprays from these oscillators spread as the move away from the oscillator's outlet. There are many well-known designs of fluidic circuits that are suitable for use with such fluidic inserts. Many of these have some common features, including: (a) at least one power nozzle configured to accelerate the movement of the liquid that flows under pressure through the insert, (b) an interaction chamber through which the liquid flows and in which the flow phenomena is initiated that will eventually lead to the spray from the insert being of an oscillating nature, (c) a liquid inlet, (d) a pathway that connects the inlet and the power nozzle/s, and (e) an outlet or exit from which the liquid exits the insert in the form of a spray.

Examples of fluidic circuits may be found in many patents, including U.S. Pat. No. 3,185,166 (Horton & Bowles), U.S. Pat. No. 3,563,462 (Bauer; feedback oscillator, which introduces some of the terminology that has become common in the fluidic oscillator industry, e.g., "power nozzle," "feedback or control passage"), 4,052,002

(Stouffer & Bray), 4,151,955 (Stouffer; island oscillator), 4,157,161 (Bauer), 4,231,519 (Stouffer), which was reissued as RE 33,158, 4,508,267 (Stouffer), 5,035,361 (Stouffer), 5,213,269 (Srinath), 5,971,301 (Stouffer; box oscillator), 6,186,409 (Srinath), 6,253,782 (Raghu; mushroom oscillator), 7,014,131 (Berning et al.; double sided oscillator), U.S. Patent Application Publication No. (USPAP) 2005/0087633 (Gopalan; three power nozzle, island oscillator), 7,267,290 (Gopalan & Russell; cold-performing mushroom oscillator), 7,472,848 (Gopalan & Russell; stepped, mushroom oscillator), 7,478,764 (Gopalan; thick spray oscillator), USPAP 2008/0011868 (Gopalan; interacting oscillators) and USPAP 2009/0236449 (Gopalan et al.; split throat oscillator).

Despite much prior art relating to the development of fluidic circuits, the nature of the housings or enclosures that surround fluidic oscillators have not changed much over the years. For example, for automotive windshield washing applications (one of the first areas in which such fluidic inserts were extensively used) a typical housing's exterior shape is aerodynamically configured from its rear face to its front face in consideration of the fact that this housing will be mounted on an automobile's hood and in front of its windshield. In such a housing's front face is an especially configured cavity or cavities that accommodate, via a press-fit insertion, one or two, see U.S. Pat. No. 6,062,491 (Hahn), fluidic oscillators. Such housings can also be modified to accommodate a diverging stack of such oscillators; see U.S. Pat. No. 7,111,800 (Berning et al.). While one generally thinks of the enclosures for these oscillators as being of an almost totally enclosing nature, this need not be the case, see FIG. 3 from U.S. Pat. No. 5,845,845 (Merke et al.) which shows a "lid" for enclosing only the boundary surface of the oscillator in which the fluidic circuit is located.

Commonly owned U.S. Pat. No. 6,938,835 (Stouffer), assigned to the assignee of the present invention, relates to a three-dimensional (3-D) scanning nozzle operating in the liquid-to-air mode, and more particularly, to a 3-D scanning nozzle in which a single jet has long wavelengths so that slugs of fluid persist for greater distances from the nozzle, thereby providing superior cleaning for hard surfaces by impact and abrasion. Prior full coverage sprays have been accomplished by fluidic oscillators that sweep sheets (e.g. see Stouffer U.S. Pat. No. 4,151,955) or by mechanically traversing a sweeping jet over the target surface (as is done in the case of some headlamp washers). Many cleaning jets distribute energy by spreading the jet and rely on wand traversing to providing further distribution. Superior cleaning has been shown by sweeping-jets issued from a fan nozzle of the type shown in Stouffer U.S. Pat. No. 4,508,267 over that of a spread jet, with static (non-sweeping) nozzle on headlamp cleaning nozzles. According to the '835 patent, a single, concentrated jet that is time-shared over an area is superior to static, multi-jet nozzles that sweep just like a fan, so in order to obtain a full-coverage spray pattern that is also more uniform in both pattern distribution as well as droplet size, the '835 patent relies on a type of fluidic oscillator that produces a random scan in both radial and tangential directions. Thus, the patent features a full coverage area spray nozzle having a cylindrical oscillation chamber bounded by an upstream end plate and a downstream end plate. An inlet aperture in the upstream end plate is coupled to a source of pressurized liquid to be sprayed on the area, and an outlet aperture at the downstream end issues a jet of the pressurized liquid to ambient. In this patent, the cylindrical wall of the oscillation chamber is defined by a line revolved about an axial line passing through the inlet aperture and the outlet aperture. The oscillation chamber is adapted to support a basic oscillatory toroidal flow pattern which remains captive within the confines of that chamber. The toroid spins about its cross-sectional axis and is supplied with energy from the jet of liquid issued into the oscillation chamber. The toroidal flow pattern has diametrically opposed cross-sections which alternate in size to cause the outlet jet to move in radial paths and also in tangential directions and thereby moves in a different radial path at each sweep, whereby there is a random sweeping, or scanning, of the jet issuing from the outlet aperture over the spray area.

As fluidic oscillators continued to be used in more types of spray applications, the opportunity arose to re-examine and improve upon the design of their enclosures as a way to improve upon the overall spraying performance of nozzle assemblies which use fluidic oscillators. Recognizing the need for the development of improved enclosures and fluidic spray assemblies to more effectively and efficiently provide a wider range of desired spray distributions, U.S. Pat. No. 8,205,812 (Hester et al), assigned to the assignee of the present application, illustrates an improved fluidic device that operates on a pressurized liquid flowing through it at a specified flow rate to generate an oscillating spray of liquid droplets having desired properties. Hester's '812 device provides fluidic spray assemblies (i.e., fluidic oscillators with novel enclosures) that can provide specific types of desired sprays that had not been achievable with conventional fluidic technology. For example, Hester's '812 device provides a fan-shaped spray that uniformly covers a relatively large surface area (e.g., a 400 $cm^2$ area at a distance of 30 cm from the spray head's exit) with liquid droplets that have large diameters (e.g., >2 mm), high velocities (e.g., > or about 4 m/sec) and possibly pulsating frequencies that are in the range of perception by the human body (e.g., < or about 30-60 hertz). Such a device provides enclosures and fluidic spray assemblies that operate at low flow rates in shower head and body spray applications that can allow for reduced flow rates so as to yield significant water savings while still yielding sprays that provide the same tactile sensations as conventional shower heads as the sprays impact upon the skin of a user, while also providing enclosures and fluidic spray assemblies that are also ideally designed for an assortment of commercial cleaning applications.

There is a need for further improvements, however. Showerheads or nozzle assemblies which cost less to assemble and provide the ability to generate usefully shaped unconventional combined spray patterns are desirable, and greater reliability and service life (while providing hi performance sprays) is a long felt need. There is also a need for improved enclosures and fluidic oscillating sprays for shower head assemblies that can provide reduced energy consumption, while still yielding sprays that provide desired tactile sensations as they impact upon the skin of a user, as well as providing better directional control of the spray to permit control of the location of the areas being wetted by the sprays from such assemblies

SUMMARY OF THE INVENTION

In striving to improve the performance of various types of fluidic sprayers, applicants have discovered that there are significant opportunities to create and introduce new enclosures for these fluidic oscillators that appreciably improve their performance. Accordingly, it is an object of the present invention to provide improved enclosures and fluidic oscillating sprays for shower head assemblies that can provide reduced energy consumption, while still yielding sprays that provide desired tactile sensations as they impact upon the skin of a user, as well as providing better directional control of the spray to permit control of the location of the areas being wetted by the sprays from such assemblies.

Another object of the present invention to provide enclosures for fluidic spray assemblies that can make "less water" feel like "more water", as by providing low flow rate sprays that provide the same tactile sensations as higher flow rates in non-fluidic sprays as they impact upon the skin of a user.

Still another object of the present invention is the provision of scanner spray assemblies having multiple outlet nozzles, with each nozzle having a preselected spray characteristic to produce improved showerhead patterns.

Another object of the present invention is the provision of scanner spray assemblies having multiple fluidic oscillators, wherein each oscillator incorporates an inlet power nozzle and an outlet selectively positioned with respect to the power nozzle to produce a preselected conical spray direction and angle.

Another object of the present invention is the provision of scanner sprayers having multiple fluidic oscillators with a minimal number of components to simplify molding and assembly procedures.

It is another object of the present invention to provide enclosures and fluidic spray assemblies that are suited both for shower massaging applications and non-massaging applications.

These and other objects and advantages of the present invention will become readily apparent as the invention is better understood by reference to the accompanying summary, drawings and the detailed description that follows.

The fluidic sprayer of the present invention, which is illustrated in its preferred embodiments as shower heads having multiple fluidic oscillator outlets producing selected spray patterns to provide all of the benefits of fluidic showerheads, with additional advantages in the provision of selectable spray characteristics and in improved manufacturing processes, and thus is generally directed to satisfying the needs set forth above and overcoming the disadvantages identified with prior art devices and methods. This is accomplished, in part, through the application in a showerhead of multiple 3-D oscillating scanner sprayers of the general type described in the commonly-owned Stouffer '835 patent discussed above, to provide multiple 3-D scanning, fluidic outputs, each providing a spray output that sweeps, or scans in a preselected conical pattern size and direction. For convenience, a showerhead incorporating the described conical spray pattern will be referred to herein as a scanner showerhead.

In its broadest aspects, the invention is directed to a method of fabricating a two-part fluidic oscillator for scanning sprayers, the steps comprising molding a hemispheric upper of an interaction region having an inlet nozzle, molding a hemispheric lower part of the interaction region having a corresponding outlet aperture and throat, and configuring the throat to produce a selected outlet scanning spray having a predetermined conical outlet spray direction and axis. Further steps include selectively offsetting the throat with respect to the axis of the corresponding opposed power nozzle by varying the outlet throat angles. For use in a showerhead or the like, the process includes providing a scanning sprayer with multiple fluidic oscillators, and providing each fluidic throat of the sprayer with a selected offset, with any combination of offsets being utilized to produce a desired overall spray pattern. The sprayer is completed by enclosing components of the oscillator circuits in a housing having a rear portion and a front panel forming an enclosed fluid plenum.

A scanner sprayer device incorporating a two-piece fluidic oscillator in accordance with the invention includes a hemispheric upper part of an interaction region having an inlet power nozzle and a hemispheric lower part of the interaction region having a corresponding outlet aperture and throat. The throat is configured to produce a selected outlet scanning spray having a predetermined conical outlet spray direction and axis. More particularly, the throat of the lower part opposes the inlet power nozzle of the upper part and is selectively offset with respect to the axis of the opposed power nozzle by the angle of the outlet throat. In this device, the hemispheric upper part and the hemispheric lower part are joined to form a two-piece fluidic oscillator chamber. A housing having a rear portion and a front panel form an enclosed fluid plenum, wherein the upper part is in fluid communication with the fluid plenum by way of the inlet power nozzle to lead fluid into the fluidic oscillator chamber, and wherein the opposed outlet throat of the lower component is in fluid communication with ambient by way of the outlet aperture and throat. The throat of the lower part opposes the inlet power nozzle of the upper part and is selectively offset with respect to the axis of the opposed power nozzle by the angle of the outlet throat. To form a showerhead or other spray device, the scanner sprayer further includes multiple fluidic oscillators having selected offsets to produce multiple outlet sprays each individually controllable by the selection of the offset for producing a composite scanning spray pattern.

In accordance with additional aspects of the present invention, a fluidic device is provided that operates on a pressurized liquid flowing through it at a specified flow rate to generate an oscillating spray of liquid droplets into a surrounding gaseous ambient environment, with the spray having preselected desired properties, such as a conical spatial distribution and cone angle, as well as the velocity, frequency and wavelength of liquid droplets in front of the device. The scanner sprayer of the invention includes a plurality of fluidic oscillators, each having a fluidic circuit for inducing oscillations in pressurized liquid that flows through the oscillator so as to emit a liquid jet in the form of a scanning conical spray of liquid droplets, the spray having preselected features such as its direction and cone angle. A housing encloses the fluidic circuit, the housing having an exterior surface that includes a front portion, or plate, with a center-point, a rear portion, or plate, and an intermediate boundary surface that connects the front and rear portions to define an interior plenum. The fluidic circuit includes a plurality of passages receiving a corresponding one of the plurality of fluidic oscillators, with the intersections of the passages with the housing front plate defining a plurality of spray outlets. The geometrical arrangement of these outlets in the housing front face is chosen so as to achieve the desired properties of the scanning spray when the device is operating at its specified flow rate. Among its many advantages, the fluidic circuit geometry of the present invention provides preselectable spray directions and angles from the spray outlets, and further simplifies the manufacture of such devices by facilitating the molding and assembly process. Further, the geometry of the device of the invention does not require a large surface seal like prior fluidic assemblies, since the assembly in some embodiments of the invention is molded in two parts that are joined by a very simple cylindrical seal. The cylindrical seal is much more robust than a large surface seal, as will be described.

In broad terms, then, the present invention is directed to scanner-type sprayer devices, such as showerheads or the like, that incorporate two-piece oscillator chambers formed with opposed upper and lower components which, when assembled, produce a fluidic oscillator chamber. The upper component is in communication with a fluid plenum chamber by way of an inlet power nozzle which leads fluid through an upper wall portion of the oscillator chamber, while the opposed lower component is in fluid communication with ambient by way of an outlet aperture and throat leading through a lower wall portion of the oscillator chamber. The power nozzle is aligned with an axis of the oscillator chamber, while the opposed outlet aperture is offset from this axis a selected amount. Fluid under pressure enters the chamber though the power nozzle and circulates in the chamber, which in the illustrated embodiments is preferably generally spherical, to create a fluidic oscillation such as that described in the above-referenced U.S. Pat. No. 6,938,835. Fluid from the oscillation chamber is ejected in a variable-direction spray that scans randomly across a selected area that is defined by the conical outer shape of the spray pattern, with the direction of the spray cone and its conical angle depending on the geometry of the outlet aperture and throat and thus by the amount by which the outlet aperture is offset from axis of the power nozzle. This geometry and offset is preselected for each fluidic oscillator in a scanner sprayer so the cumulative effect of all the spray outlets produces a desired overall scanner spray pattern. Each spray cone may have a different geometry, or they may be all the same, or any combination may be used to produce the desired overall sprayer effect.

In accordance with the present invention, then, there is disclosed a scanner sprayer having a housing which receives a front plate to define a fluid plenum. Mounted in the front plate and having inlet power nozzles in fluid communication with the plenum and outlet throats in fluid communication with ambient are a plurality of fluidic oscillator circuits that generate scanner sprays having preselected characteristics such as direction and conical angle to produce a selected sprayer pattern having desired droplet sizes and uniformity as are particularly desirable in body sprayers and showerheads. In the disclosed embodiments of the invention, the oscillator circuit has a two-part configuration for ease of manufacture, with the parts being joined during assembly of the sprayer to form a generally spherical fluidic oscillator interaction region. An upper part of the circuit incorporates an upper hemispherical half of an oscillator interaction region and a single inlet power nozzle which is upstream of the interaction region and supplies under pressure a fluid to be sprayed. A lower part of the circuit incorporates a lower hemispherical half of the interaction region and a single outlet aperture and outlet throat through which fluid is ejected in a selected 3-dimensional scanning spray pattern to ambient.

In a first embodiment, the lower half of the fluidic oscillator circuit is formed, as by molding, in a lower front plate for the sprayer, with the front plate incorporating a preselected number of substantially hemispherical depressions incorporating outlet apertures and defining the lower half of the fluidic circuit. The upper half of each circuit is formed by a corresponding insert which incorporates a substantially hemispherical dome and incorporates the oscillator power nozzle, and which is partially inserted and secured in the lower front plate depression. A top housing component contacts at a sealed joint the top surface of the front plate and forms a plenum which encloses the oscillator circuit inserts. A fluid under pressure supplied to the sprayer enters the plenum and is distributed through the power nozzle of each oscillator circuit to the corresponding interaction region. This fluid circulates in the spherical interaction region and generates oscillations in the fluid, causing the fluid to be ejected as a conical scanning spray having characteristics of axial direction and cone angle determined by the location of the outlet with respect to the axis of the corresponding power nozzle.

Another embodiment of the invention incorporates a two-piece oscillator circuit insert, wherein a top half includes a power nozzle leading into a hemispherical dome and a bottom half includes a hemispherical depression incorporating an outlet aperture and throat. The sprayer includes a front plate having multiple openings for receiving the inserts, and a back plate, or housing top component, which is secured to the front plate to enclose the inserts in a plenum and to force the inserts tightly into the front plate openings. Spacer posts on the top of each insert contact the inner surface of the housing top plate to securely position the inserts a to act as turbulence filters. In operation, fluid under pressure supplied to the sprayer enters the plenum and is distributed into the power nozzle of each oscillator circuit through spaces between the spacer posts and then into the corresponding interaction region. This fluid circulates in the spherical interaction region, as described above, and generates oscillations in the fluid, causing the fluid to be ejected as a conical scanning spray having characteristics of axial direction and cone angle determined by the location of the outlet with respect to the axis of the corresponding power nozzle.

In still another embodiment, multiple two-piece oscillator circuits for a scanner sprayer are formed, as by molding on a single layer of a front panel, all of the downstream halves of the interaction regions and their outlets and scanner throats. Similarly, the upstream halves of the interaction regions and all of their power nozzles are molded in another single layer of the front sprayer panel. In this embodiment, a third layer is provided to support the first two layers and incorporates corresponding fluidic circuit apertures for receiving the downstream halves of the oscillator circuits. The front panel is secured to a top housing member, or component, to form an inner plenum which surrounds the power nozzles. Once again, fluid under pressure supplied to the sprayer enters the plenum through the top housing member and is distributed into the power nozzle of each oscillator circuit through spaces between spacer posts at the power nozzles and then into the corresponding interaction region. This fluid circulates in the spherical interaction region, as described above, and generates oscillations in the fluid, causing the fluid to be ejected through the outlet throat as a conical scanning spray having characteristics of axial direction and cone angle determined by the location of the outlet with respect to the axis of the corresponding power nozzle.

In accordance with the method of the invention, each of the two-part fluidic oscillators is fabricated so that the inlet nozzles, hemispheric upper and lower parts of the interaction region and the corresponding outlet apertures and throats are configured to produce selected outlet scanning sprays having predetermined conical outlet spray directions and axes. This is accomplished in accordance with the invention by selectively offsetting the outlet throat with respect to the axis of the corresponding opposed power nozzle, with the offset being accomplished by varying the outlet throat angles. Each fluidic circuit of a sprayer is provided with a selected offset, with any combination of offsets being utilized to produce the desired spray pattern. The components of the oscillator circuits are enclosed in a housing having a rear portion enclosing an inlet plenum and a part of the circuit and a front panel incorporating the remainder of the circuit and its scanning spray outlets. Thus, the method includes selecting each spray outlet to have an offset with respect to its corresponding power nozzle axis to create a desired overall pattern, with, for example, all the individual sprays being directed in a narrow pattern, as might be desirable for a body spray, or selecting them to create a broader overall pattern as might be desirable for a showerhead.

This scanner nozzle member configuration and showerhead assembly and method of the present invention provides some significant advantages, including:

1. The simplicity of the geometry of each of a multiplicity of fluidic scanner nozzles, wherein each fluidic nozzle includes an essentially spherical interaction region and opposed inlet lumen (power nozzle) and outlet orifice (throat) features that allow for simplified construction of scanner fluidic arrays.
   a. All of the scanner throats are located in the downstream half of the interaction regions and thus can be molded in one piece of the showerhead. Since such fluidic devices are typically made by plastic injection molding methods, those knowledgeable with such manufacturing methods will understand that such manufacturing methods impose constraints on the geometry of such devices, and the molding of the downstream portions of the interaction regions in one piece has significant advantages. In this scenario, the power nozzle and upstream half of the interaction region are molded individually for each fluidic, so that the component count for the fluidics is equal to the number of fluidics plus one. This is more than in a prior fluidic shower, but the components are much simpler to design, mold, and assemble, as will be illustrated below.
   b. Alternatively, all of the scanner throats for the downstream half of the interaction regions can be molded in one piece of the showerhead and all of the power nozzles and upstream half of the interaction regions can be molded in one other piece of the showerhead. In this scenario, component count for the fluidics is two, no matter how many fluidics are included. This scenario also allows each showerhead to be designed and built to whatever scanner fluidic geometry is best suited rather than using the standard components that are typical in prior fluidic showerheads.
      i. To facilitate the alignment of a large number of fluidics in the assembly, one of the components may be molded out of a flexible material to allow it to conform to the other hard plastic component. Alternatively, to facilitate the alignment of a large number of fluidics in the assembly of the present invention and to allow aiming or bending of the fluidics into various aim angles, both of the components may be molded out of a flexible material to allow them to conform to each other and to a hard face or backing plate that holds prescribed aim angles.
2. The economy inherent in the manufacturing process for making the scanner fluidics and the showerhead nozzle assembly—the essentially spherical interaction region's coaxial, opposed inlet (power nozzle) and outlet (throat)—provide the option to economically mold the downstream halves of the interaction regions in the one piece of the showerhead assembly, as discussed above. Since the power nozzle and upstream half of the interaction region are molded individually for each fluidic, the assembly of the showerhead is simplified and the components are much simpler to design and mold.

The scanner fluidic showerhead of the present invention contains many more spray orifices or openings (more fluidics) than are available with prior fluidic showerheads, thereby overcoming one of the perceived drawbacks for such prior fluidic-equipped showerheads. Further, the fluidic oscillator outlet sprays may incorporate various outlet geometries to produce individually selected spray directions and cone angles to produce a desirable overall spray pattern. The method of manufacture and configuration of the present invention provides an economical and very effective seal for fluidic circuits in the scanner fluidic showerhead assembly of the present invention. The scanner showerhead of the present invention need not be as expensive to make as prior fluidic showerheads because there can be fewer components as compared with prior fluidic showerheads.

Thus, there has been summarized above, rather broadly, the present invention in order that the detailed description that follows may be better understood and appreciated. There are, of course, additional features of the invention that will be described hereinafter and which will form the subject matter of the claims to this invention. Accordingly, the above and still further objects, features and advantages of the present invention will become apparent upon consideration of the following detailed description of specific embodiments thereof, particularly when taken in conjunction with the accompanying drawings, wherein like reference numerals in the various figures are utilized to designate like components.

BRIEF DESCRIPTION OF THE DRAWINGS

FIGS. 1-5 are schematic illustrations of Applicant's prior 3-dimensional (3-D) scanning nozzle illustrating the general type of fluidic oscillator and sprayer utilized in the present invention.

DESCRIPTION OF PREFERRED EMBODIMENTS

Figure 1:
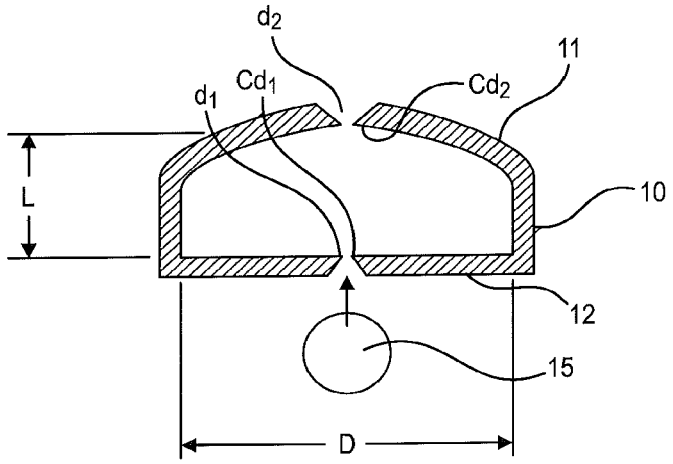
FIG. 1 (Prior Art)
Figure 2:
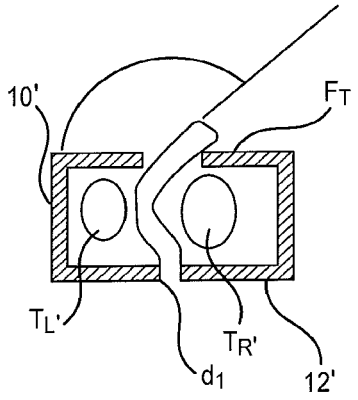
FIG. 2 (Prior Art)
Figure 3:
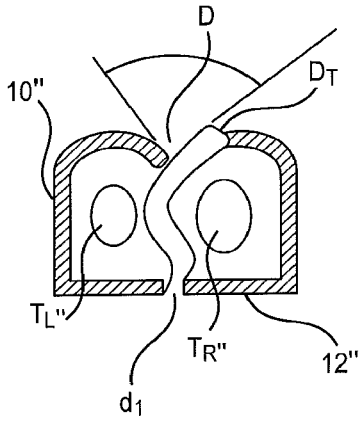
FIG. 3 (Prior Art)

Before explaining exemplary embodiments of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

In broad terms, the present invention is directed to scanner-type sprayer devices, such as showerheads or the like, that incorporate two-piece oscillator chambers formed with opposed upper and lower components which, when assembled, produce a fluidic oscillator chamber. The upper component is in communication with a fluid plenum chamber by way of an inlet power nozzle which leads fluid through an upper wall portion of the oscillator chamber, while the opposed lower component is in fluid communication with ambient by way of an outlet aperture and throat leading through a lower wall portion of the oscillator chamber. The power nozzle is aligned with an axis of the oscillator chamber, while the opposed outlet aperture is offset from this axis a selected amount. Fluid under pressure enters the chamber though the power nozzle and circulates in the chamber, which in the illustrated embodiments is preferably generally spherical, to create a fluidic oscillation. Fluid from the oscillation chamber is ejected in variable-direction spray having a changing, or scanning cross-sectional pattern and with an outer conical shape, with the direction of the spray cone and its conical angle depending on the geometry of the outlet aperture and throat and by the amount by which the outlet aperture is offset from axis of the power nozzle.

This geometry and offset is preselected for each fluidic oscillator in a scanner sprayer so the cumulative effect of all the spray outlets produces a desired scanner spray pattern. Each spray cone may have a different geometry, or they may be all the same, or any combination may be used to produce the desired overall sprayer effect.

Figure 4:
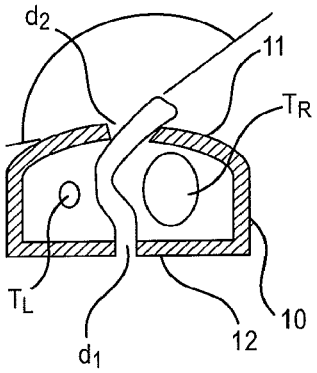
FIG. 4 (Prior Art)

As an introduction to the present invention, attention is directed to the prior art configuration of FIGS. 1-5, which illustrates a fluidic device that operates on a pressurized liquid flowing through it at a specified flow rate to generate an oscillating, cone-shaped spray of liquid droplets having desired properties. This device, which is described in commonly-owned U.S. Pat. No. 6,938,835 described above, the disclosure of which is hereby incorporated herein by reference, provides fluidic spray assemblies (i.e., fluidic oscillators with novel enclosures) that can provide specific types of desired sprays that had not been achievable with conventional fluidic technology, and more particularly demonstrates a 3-dimensional scanning nozzle. As shown in FIGS. 1 and 4, this fluidic device is a figure of revolution: a cylinder 10 with a domed-top endplate 11. The top end plate 11 and bottom end plate 12 have round orifices or apertures $d_2$ and $d_1$, respectively, which, preferably, are closely sharp edged or chamfered as shown at $Cd_1$ and $Cd_2$. As shown in FIG. 4, in operation, liquid under pressure entering the bottom of the chamber generates an oscillating toroid T, which is smallest on the left side $T_L$ and largest on the right side $T_R$, but this condition changes or alternates. The toroid flow pattern remains captive within the confines of the oscillation chamber, spinning about its cross-sectional axis and being supplied energy from the liquid jet entering from orifice $d_1$.

The toroidal flow pattern (also shown in FIGS. 2 and 3) has diametrically opposed cross-sections which alternate in size to cause the fluid in the oscillation chamber to move in radial paths and also in tangential directions and thereby choose or traverse a different radial path at each sweep. As a result, there is a random-direction sweeping of the outlet jet issuing within a conical space facing away from the outlet orifice at the outlet area. As illustrated in FIG. 5, the randomly directed sweeping, or scanning single outlet jet quickly covers the area A, which is a cross-section of the conical spray taken in a plane transverse to the spray's central axis, in a substantially uniform, generally conical distribution with substantially uniform slugs or droplets of liquid. Thus, the scanning jet automatically and continually distributes the jet's effects (cleaning, for example) over an area, even if movement of a wand (not shown) in which the nozzle is mounted were halted. All of the outlets disclosed and illustrated in this patent promote recirculation on the side to which the jet is deflected, but the dome shape has the most unfavorable angle to promote recirculation on the opposite side, thereby allowing a larger deflection of the jet.

Figure 6A:
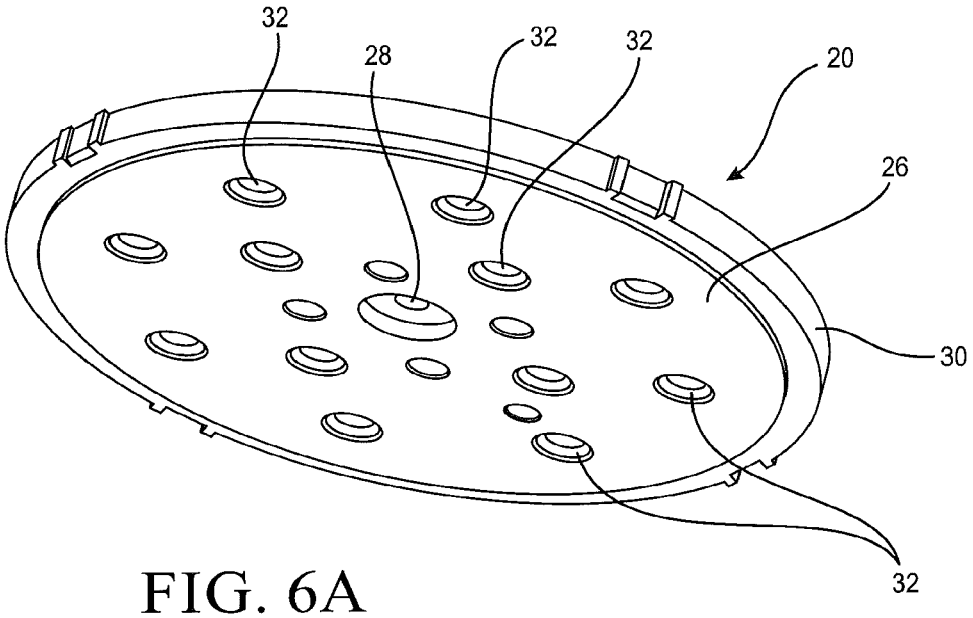
FIG. 6A (PRIOR ART)
FIGS. 6A and 6B diagrammatically illustrate a prior art showerhead utilizing fluidic circuits producing conventional fan-shaped sprays.
Figure 6B:
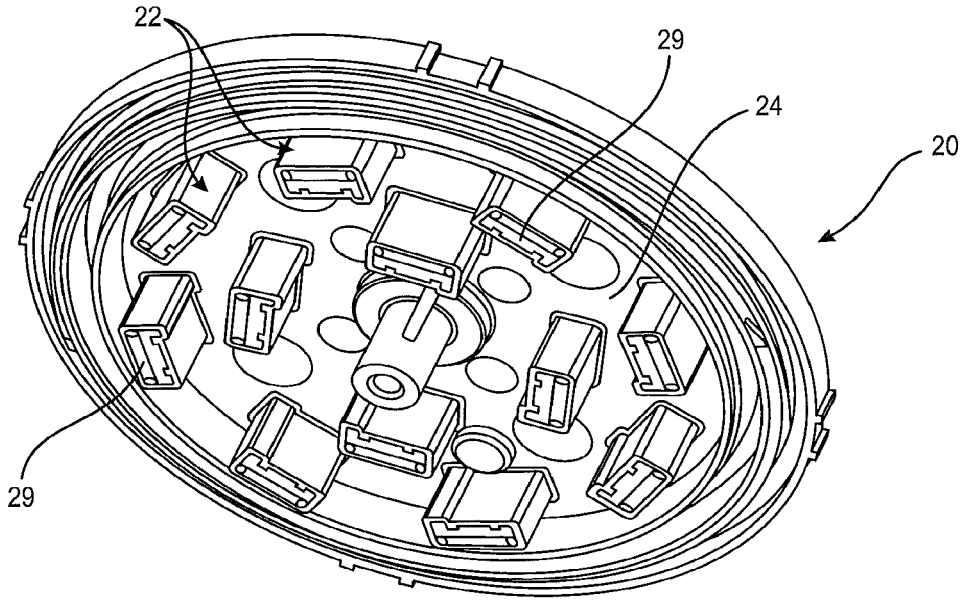
FIG. 6B (PRIOR ART)

The use of fluidic circuits in sprayers such as shower heads is illustrated in prior art FIGS. 6A and 6B, taken from commonly owned U.S. Pat. No. 8,205,812 (Hester et al), the disclosure of which is incorporated herein by reference. Hester's '812 patent illustrates a fluidic device 20 that operates on a pressurized liquid flowing through it at a specified flow rate to generate an oscillating spray of liquid droplets having desired properties. Hester's '812 device provides multiple fluidic spray assemblies (i.e., fluidic oscillators with novel enclosures) indicated generally at 22 that can provide specific types of desired sprays. For example, as noted above, Hester's '812 device provides a spray that uniformly covers a relatively large surface area (e.g., a 400 $cm^2$ area at a distance of 30 cm from the spray head's exit) with liquid droplets that have large diameters (e.g., >2 mm), high velocities (e.g., > or about 4 m/sec) and pulsating frequencies that are in the range of perception by the human body (e.g., < or about 30-60 hertz). In accordance with Hester's '812 patent, a fluidic device that operates on a pressurized liquid flowing through it at a specified flow rate to generate an oscillating spray of liquid droplets into a surrounding gaseous environment and with the spray having desired properties (e.g., average spatial distribution, size, velocity, frequency and wavelength of liquid droplets at a defined distance in front of the device) includes a plurality of fluidic oscillators within the assemblies 22, each having a channel that is part of a fluidic circuit for inducing oscillations in the pressurized liquid that flows through the oscillator so as to emit a liquid jet in the form of an oscillating spray of liquid droplets. The device includes a housing having an exterior surface that includes a rear face 24 and a front face 26 with a center-point 28. An intermediate boundary surface 30 connects the faces. A plurality of passages 29, each of which extends through the housing and intersects with the front and rear faces, are configured to allow for the insertion of one of the plurality of fluidic oscillators into each of the passages, so that the intersections of the passages with the housing front face define a plurality of outlets 32. The geometrical arrangement of this housing's passages and their inserted oscillators is seen in FIG. 6B to consist of an outer octagonal array of eight fluidic-oscillator-containing passages that is centered on the center-point of the front face. Inside this outer array is located an inner array of four fluidic-oscillator-containing passages that is also centered on the center-point of the enclosure's front face.

The geometrical arrangement of the Hester '812 outlets in the housing front face was chosen to achieve the desired properties of the oscillating spray when the device is operating at its specified flow rate. The fluidic oscillators chosen for this application were sized and proportioned so that, at the fluid pressures and flow rates at which they operated, they caused the liquid jets flowing from them to oscillate at a frequency of approximately 50 hertz and with the wavelength of approximately 10 cm. The result is a large area spray that, to the human touch, has very pleasing, vigorous (because of the relatively high velocity and large diameter of the droplets) massaging qualities. Furthermore, this spray is achieved at surprisingly low flow rates (i.e., ranges of 1.2-1.9 gpm versus non-fluidic, spray heads operating in the range of 2.0-2.5 gpm) as compared to those used by the currently available, non-fluidic, massaging spray heads which cover significantly smaller surface areas. In accordance with this prior art, maximum flexibility is provided in the design of showerhead oscillators with differing fan angles, oscillation frequencies, droplet sizes and velocities.

Hester's '812 showerhead (like traditional jet type shower heads) does not provide pleasing spray patterns, droplet size, droplet velocity, and temperature uniformity at very low flow rates (2 gpm or less) for showering. Furthermore, most prior fluidic showerheads have very few openings and so (as noted above) were hastily judged inferior by consumers who could spray the showerhead before purchase. In addition, prior fluidic showerheads were difficult to manufacture because of the difficulty in sealing the fluidic passages, and tend to be more expensive than conventional jet showers because of the number of component fluidics.

We reprise that prior art so that we can have a well-defined context for the scanner fluidic showerhead and method of the present invention as described below and illustrated in the accompanying FIGS. 7-33A, to which reference is now made. The showerhead assembly and method of the present invention overcomes the problems (both perceived and real) of prior fluidic showerheads and provides an improved fluidic assembly that is also suitable for other spraying applications. In prior scanner fluidic showerheads, one scanner replaces 2-4 jets due to its small cone angle and uniform distribution. Thus, in a typical prior fluidic showerhead, one fluidic replaces 10-15 jets, leaving a typical prior fluidic showerhead with 4-10 openings, where a comparable jet type would have 40-100 openings, leading to the perception by potential consumers that fluidic showerheads had too few openings. The scanner fluidic showerhead as described and illustrated herein contains many more openings, and thus more fluidics, than prior devices. Thus, the fluidic spray output scanner throats provided in the devices of the present invention deliver uniform cone angles of about 8°. This is larger than a standard jet ~2° cone, but smaller and more uniform than prior fluidics, ~20°×5° for '2D' and ~35°×20° for '3D' fluidic chips. A scanner fluidic showerhead in accordance with the invention can have from 5-40 openings, negating the perception by potential purchasers that they have too few spray openings. Further, the unique construction of the present device overcomes manufacturing difficulties of prior devices by making it very easy to seal its fluidic circuits, and in addition, it need not be as expensive as prior fluidic showerheads because there need not be as many components as were needed in such prior devices.

Turning now to a more detailed description of the present invention, reference is made to FIGS. 7-13, which illustrate at 50 a first embodiment of a fluidic scanning spray device which may be in the form of a hand-held body sprayer or shower, a fixedly or movably mounted showerhead, or the like, and which for convenience will be referred to herein as a scanner showerhead which incorporates a multiplicity of fluidic oscillators. The scanner showerhead 50 preferably is of a molded plastic material and includes a two-piece housing 52 having a rear (or top as viewed in FIG. 7) housing component 54 and a front plate (or bottom, as viewed in the Figure) housing component 56 mated at an interface 58 to form an enclosed plenum which encloses the fluidic oscillator elements of the invention, as will be described. As illustrated, the top housing component 54 incorporates a fluid inlet 60 for connection to a source of fluid under pressure, such as a conventional sprayer or shower supply fixture or hose (not shown), to which it is connected as by means of external threads as shown at 62. The diameter of the interior 64 of the inlet is stepped down, as at a first inwardly extending shoulder 66, a second inner shoulder 68 which is secured to an inner wall 69 formed by shoulder 66, and a final inwardly extending shoulder 70 to form a small-diameter inlet 71 through which fluid flows, as indicated by arrows 72, into the interior plenum 74 defined between the rear and front components, or portions, 54 and 56 of the housing 52. In the illustrated embodiment, the inner shoulder 68 is in the form of a ring secured to wall 69 by, for example, three radial arms indicated at 78, with the spaces 79 between the radial arms directing fluid flow indicated by arrows 80 into the plenum and cooperating with the central opening 71 to reduce turbulence in the fluid flow into the plenum 74 for even distribution of the flow to the outlet fluidic oscillators to be described.

Figure 8:
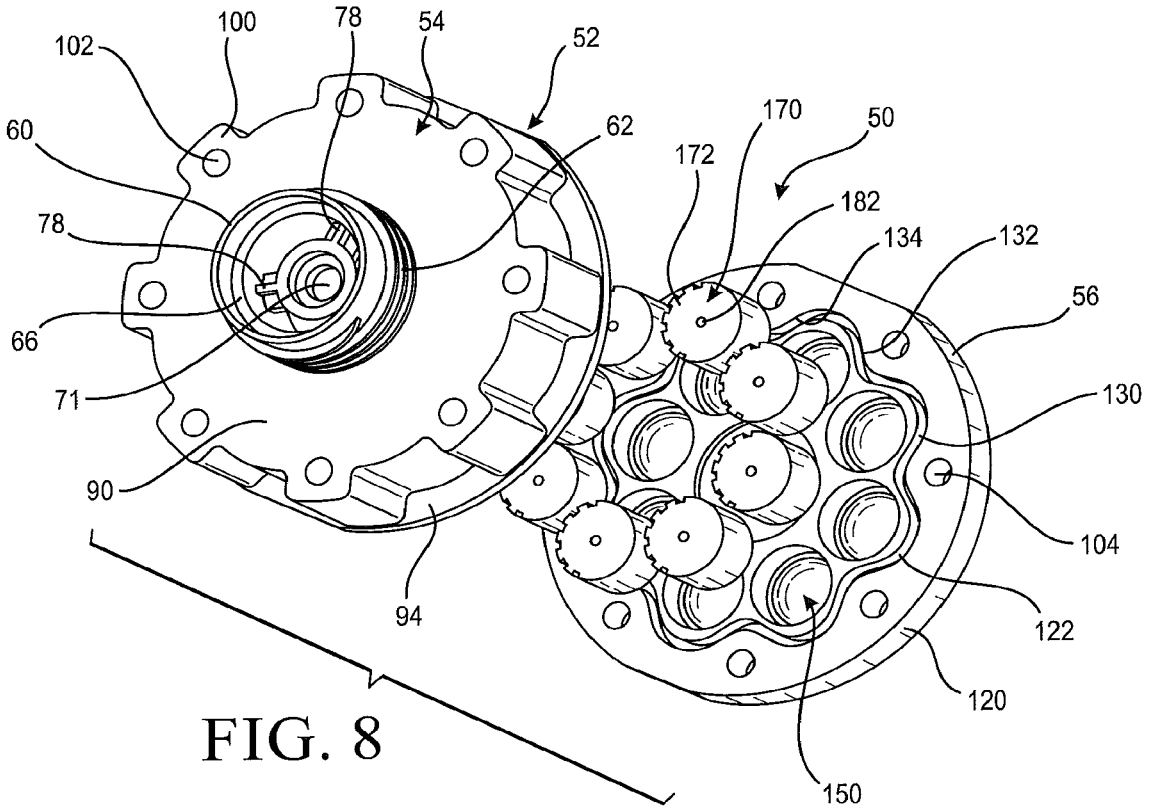
FIG. 8 is an exploded top perspective view of the device of FIG. 7, illustrating, from left to right, top (or rear) and bottom (or front) housing and internal components, in accordance with the present invention.
Figure 9:
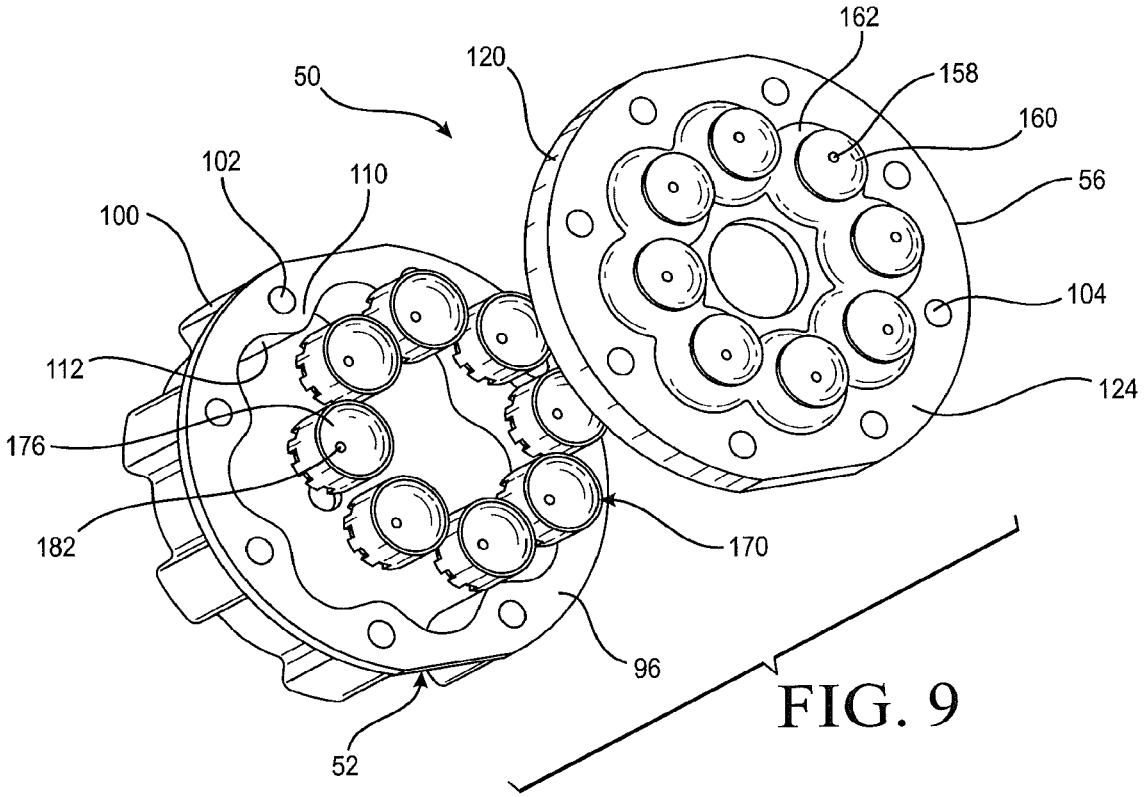
FIG. 9 is an exploded bottom perspective view of the device of FIG. 7, illustrating, from left to right, top and bottom housing and internal components, in accordance with the present invention.
Figure 10:
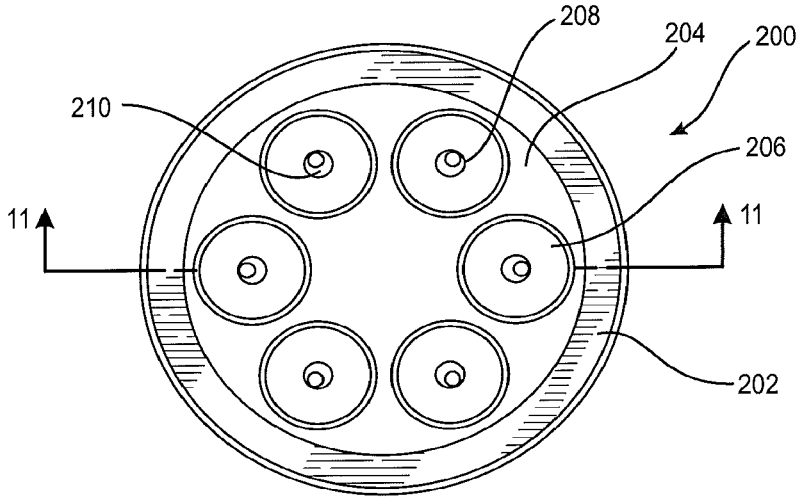
FIG. 10 is a simplified diagrammatic top plan view illustrating the features of a bottom housing component or front plate of a second embodiment of the present invention.
Figure 11:
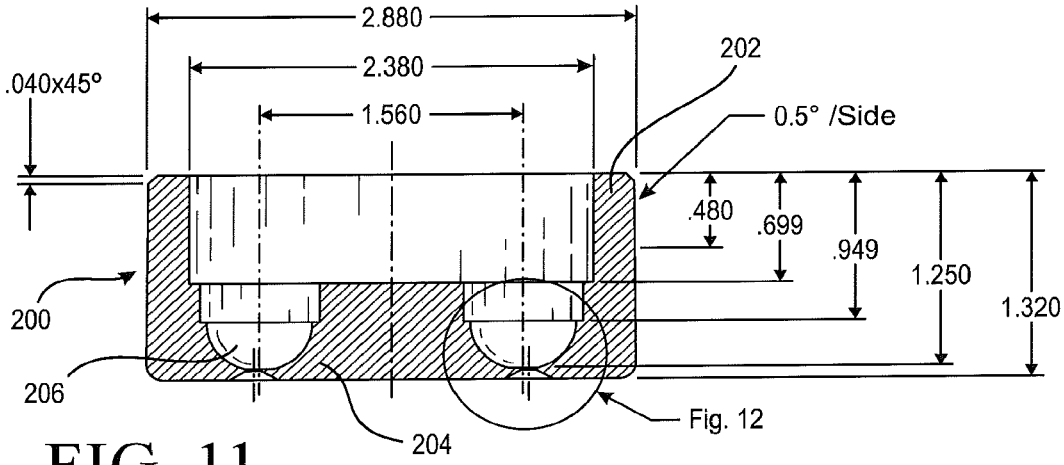
FIG. 11 is a cross-sectional view taken along lines 11-11 of FIG. 10.
Figure 12:
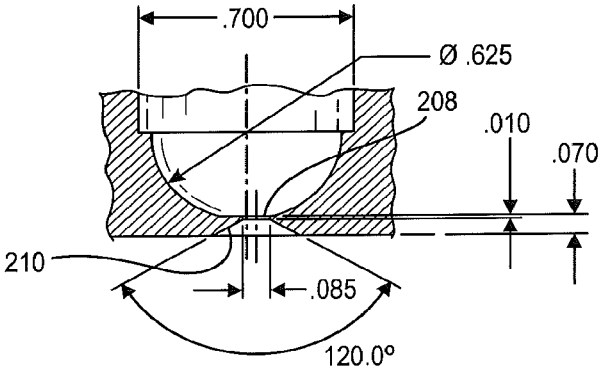
FIG. 12 is a detailed view of region A of FIG. 11.
Figure 13:
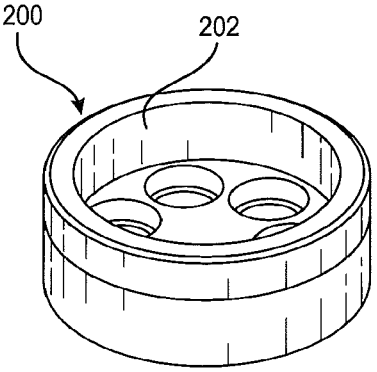
FIG. 13 is a top perspective view of the component of FIG. 11.

The top housing portion 54 is generally cup-shaped, forming a housing cover portion having a top wall 90, which incorporates the centrally-located inlet 60, and a circumferential, downwardly-extending (as viewed in FIG. 7) side wall 92 having at its bottom an outwardly-flared circumferential sealing flange 94 which incorporates a flat bottom sealing surface 96. As best seen in FIG. 8, the housing cover 54 incorporates around the sidewall 92 a plurality of outwardly-extending radial protrusions 100 spaced around the housing side wall. Each protrusion includes a through aperture 102 which is aligned with a corresponding aperture 104 in the bottom housing 56 for receiving a suitable fastener for assembly of the showerhead 50. It will be noted that at the location of each outward protrusion 100, the wall 92 of top housing component 52 incorporates a curved, inwardly-extending projection, or bulge 110, as best seen in FIG. 9, which serves to provide sufficient thickness in the side wall 92 to accept the apertures 102. The multiple protrusions and their corresponding inward projections produce a curved circumferential inner wall surface 112, as seen in FIGS. 7 and 9.

The bottom, or front plate housing component 56 of the housing 52 includes a generally planar bottom wall 120 having a back (or top, as viewed in FIG. 7) surface 122, a front surface 124, and a circumferential wall 126. As best seen in FIG. 8, the housing component 56 includes multiple circumferentially-spaced apertures 104, with the back surface 122 incorporating a sinuous sealing groove 130 having inner and outer walls 132 and 134 and a groove bottom 136 for receiving a flexible circular seal (not shown). The inner wall 132 of the sealing groove follows the curvature of the curved inner wall 112, so that when the housing 52 is assembled, upper and lower parts 54 and 56 of the housing engage at interface 58 with the surface 96 of the top housing 54 engaging the back surface 122 of bottom housing 56 and covering the sealing groove 130 to provide a fluid-tight seal between these upper and lower components when a suitable flexible seal is in the groove 130. The scanner fluidic geometry contained in the housing, as will be described, does not require a large surface seal like prior fluidics so that the scanner fluidic of this invention can be molded in two parts that, when joined, provide a sealed housing using a very simple cylindrical seal that is much more robust than a large surface seal.

Molded as a part of the front plate housing component 56 are a plurality of concave depressions 150, illustrated in perspective view in FIG. 8, which form the lower halves of fluidic oscillators for the sprayer 50. For clarity, only one such depression will be described in detail, it being understood that all of them, in this case eight, are substantially alike and are formed during the molding process for making the component 56. Each depression is molded to incorporate a cylindrical upper portion 152, an inward ledge, or shoulder 154, and a substantially hemispherical lower cavity portion 156 which will form a lower part of a two-piece scanner fluidic oscillator element when the scanner showerhead is assembled. At the bottom of the lower cavity portion, slightly offset radially outwardly from a centerline of the fluidic oscillator, and thus off center of the depression 150, is an outlet aperture 158 which opens through a throat portion 160 formed in a wall portion 162 of the depression 150. As best seen in FIG. 9, the throat portion 160 flares outwardly from the aperture 158 to produce a scanning fluid spray pattern, as will be described.

Figure 7:
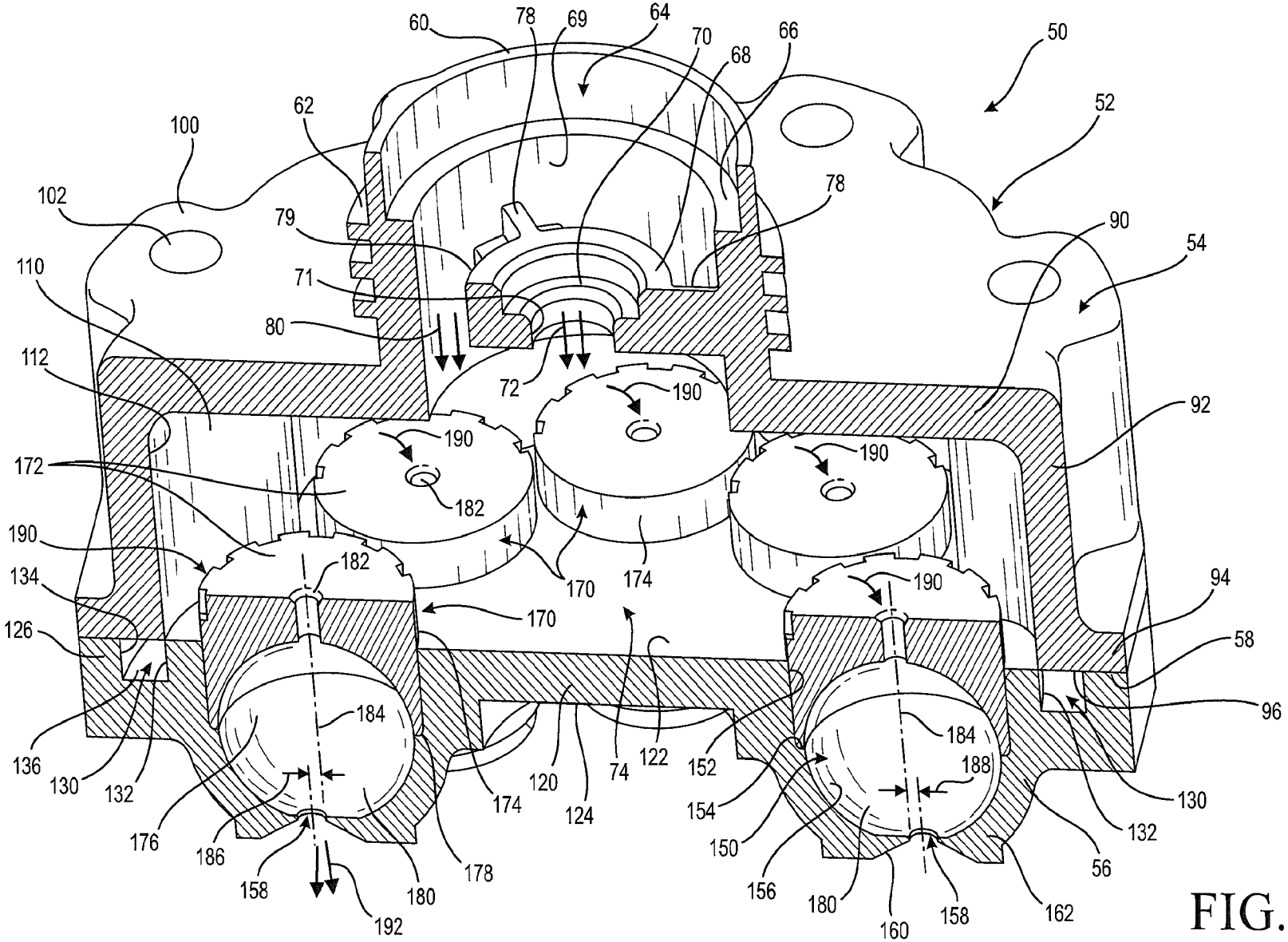
FIG. 7 illustrates a perspective cross-sectional view of a first embodiment of a scanner showerhead incorporating eight fluidic oscillators having outlet apertures and throats providing selected scanning spray patterns in accordance with the present invention.

Mounted within each depression 150, as illustrated in FIG. 7, is a corresponding cylindrical fluidic power nozzle insert 170, which forms the second part of the two-part fluidic oscillator. The insert has an upper planar surface 172 and a cylindrical side wall 174 which has a diameter selected to fit snugly into the upper portion 152 of its corresponding depression. As illustrated in the cross-section of FIG. 7, the bottom of each insert incorporates an open, downwardly facing substantially hemispherical dome 176 having a cylindrical bottom edge 178 which engages the ledge 154 in its corresponding depression when assembled. The inert dome and its corresponding depression form a spherical fluidic oscillator interaction chamber 180. Centrally located in the upper surface of each cylindrical insert is an inlet passage 182 having an axis 184, which is also the axis of the cylindrical insert 170, and forming a power nozzle leading into the insert interior dome and thus into the interaction chamber 180 formed by each insert with its corresponding depression. As illustrated in FIG. 7, it will be noted that the outlet apertures 158, and the throats 160 of each fluidic oscillator are offset radially from the axis 184, and as illustrated, these offsets are of selected, usually different dimensions to provide predetermined different but complementary outlet spray patterns of each oscillator output scanner spray. In the illustrated embodiment, the outlets are spaced radially outwardly by different distances 186 and 188 in the two fluidic oscillators illustrated in cross-section in FIG. 7, but it will be understood that the offset may be in any direction from the axis 184, the offsets may all be the same, or a selected mixture of offsets, or there may be no offsets, as selected for the desired scanner spray pattern. It is noted that the inserts may be partially serrated around their upper edges 190 for ease of handling.

The method of assembly of showerhead 50 involves positioning an insert 170 into each of the cylindrical upper portions 152 of depressions 150 in the front plate so that the bottom 178 of the insert engages the ledge 154, with the inserts being secured in place by the tight fit of the insert outer side wall 174, thereby forming a plurality, in this embodiment for purposes of illustration, eight fluidic oscillator interaction chambers and corresponding scanning spray outlets and outlet throats. A seal is placed in the groove 130 and the back and front portions 54 and 56 are positioned and aligned and are secured together by suitable fasteners, such as screws or bolts, to provide a fluid-tight enclosure. In operation, the shower head is secured to a suitable source of fluid under pressure, which flows into the interior plenum, or fluid manifold 74 of the housing, as indicated by arrows 72 and 80. The fluid circulates in the chamber and flows at substantially equal flow rates into the several inlet power nozzles 182, as illustrated by arrows 190. The fluid enters the fluidic interaction chambers 180 under pressure, circulates in the chamber to produce a fluidic oscillation, and is ejected through the corresponding outlet aperture 158 and throat 160 to generate from each outlet a scanning fluidic spray output which is delivered in a uniform cone angle, illustrated in FIG. 7 by arrows 192. This scanning spray output is similar to that illustrated in FIG. 5, in that it randomly scans across and around the defined cone angle to produce a highly desirable flow pattern for use, for example in a shower.

The simplicity of the scanner geometry—an essentially spherical interaction region with opposed, but selectively offset, inlet (power nozzle) and outlet (throat)—allows for simplified construction of scanner fluidic arrays. As illustrated in the embodiment of FIGS. 7-9 and in the related second embodiment of the invention illustrated in FIGS. 10-15, such simplified construction is accomplished by molding the scanner throats and the downstream half of the interaction regions in one piece of the showerhead. In this scenario, as discussed above, the inserts containing the power nozzle and the upper, or upstream half of the interaction region are molded individually for each fluidic so that the component count for the fluidics device is equal to the number of fluidics plus one. This is more than in a prior fluidic shower, but the components are much simpler to design, mold, and assemble.

Figure 14:
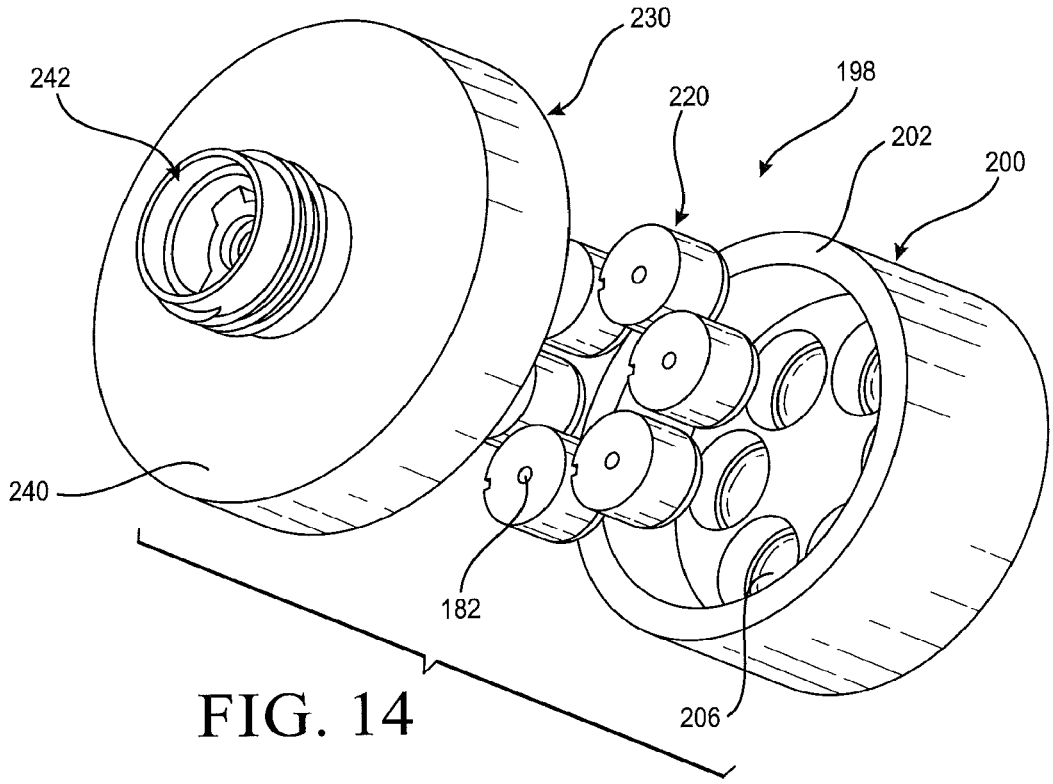
FIG. 14 is an exploded top perspective view of the second embodiment of the showerhead or nozzle assembly, illustrating from left to right in the Figure top (or rear) and bottom (or front) housing components as well as internal components of a scanning showerhead incorporating six fluidic oscillator chambers, in accordance with the present invention.
Figure 15:
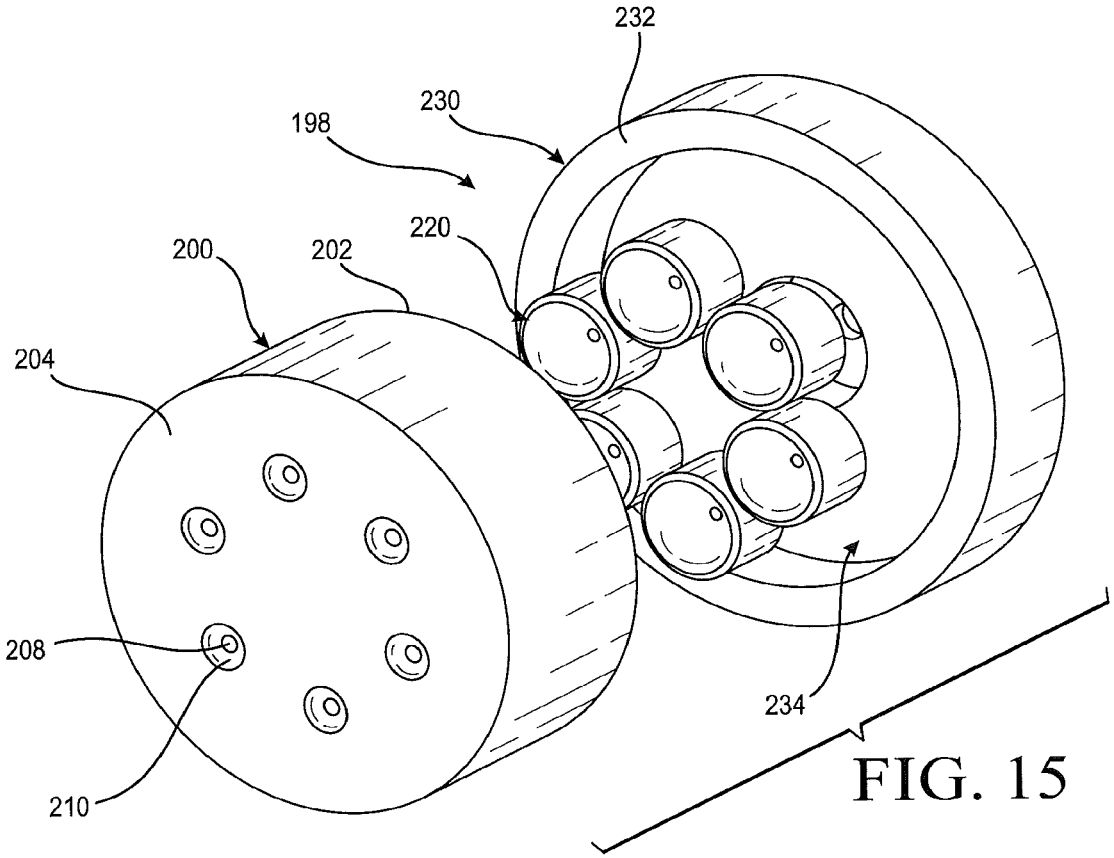
FIG. 15 is an exploded bottom perspective view of the device of FIG. 14, illustrating from left to right in the Figure the bottom and top housing and internal components, in accordance with the present invention.
Figure 16:
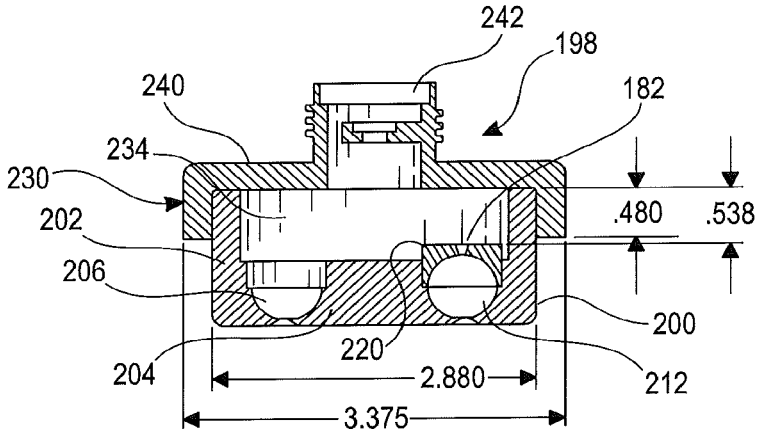
FIG. 16 is a diagrammatic cross-sectional assembled view of the device of FIGS. 14 and 15.
Figure 17:
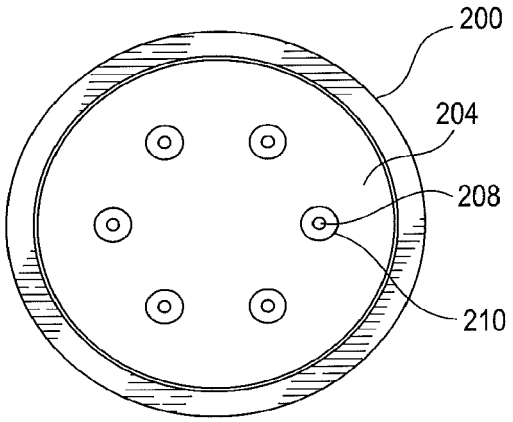
FIG. 17 is a bottom plan view of the device of FIG. 16.

In the embodiment of FIGS. 10-17, which are directed to a second embodiment 198 of the present scanner showerhead or sprayer invention, FIGS. 10-13 diagrammatically illustrate a downstream, or front plate portion 200 of such a scanner spray utilizing multiple fluidic oscillator scanner sprays in accordance the present invention. In this illustration, front plate 200 is generally cup-shaped, having an upstanding cylindrical side wall 202 and a bottom wall 204 in which a desired number, in this case six, fluidic depressions 206 are formed. These depressions have corresponding outlet apertures 208 and scanner throats 210, in the manner described above with respect to the depression 150, outlet 158 and throat 160 of FIG. 7. FIGS. 10-13 illustrate the dimensions of a typical six-spray scanner shower head. In this embodiment, and as best seen in FIGS. 14 and 15, suitable inserts 220 are provided, having the shape described above with respect to inserts 170 in FIGS. 7-9, and being securable in the corresponding depressions 206 to form corresponding fluidic interaction chambers 212, as illustrated diagrammatically in FIG. 16. In this embodiment, a rear, or upper housing portion 230 is configured to match and enclose the sidewall 202 of the front portion 200 of the assembly, and thus itself is generally cup-shaped, having a downwardly (or forwardly) facing cylindrical side wall which surrounds and engages the upper edge of the sidewall 202, as best seen in FIG. 16, to provide a water-tight plenum 234 within the housing 198. As with the embodiment of FIGS. 7-9, the housing portion 230 has a rear wall 240 carrying a threaded fluid inlet fitting 242, by which fluid under pressure is supplied to the interior plenum formed within showerhead 198. As before, the inlet fluid circulates in the plenum 234 and flows through the insert power nozzles 182, the fluidic interaction chambers 212, and outlets 208 through throats 210. As noted above with respect to FIGS. 7-9, the outlets 208 and throats 210 are selectively offset from the axes of their corresponding opposed inlet power nozzles 182 to produce the desired scanner spray pattern.

Figure 18:
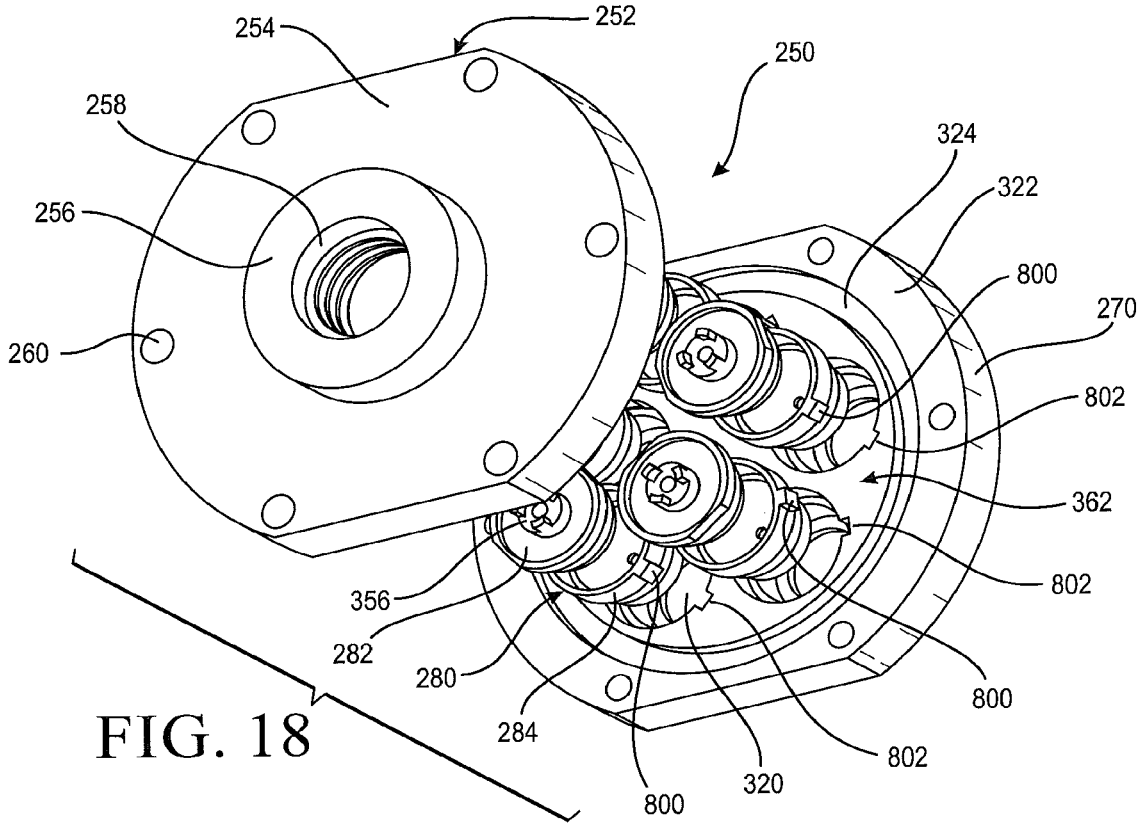
FIG. 18 is an exploded top perspective view of a third embodiment of the present invention, illustrating from left to right in the Figure top and bottom housing and internal components of a scanning showerhead incorporating five two-piece fluidic oscillator outlet chambers, in accordance with the present invention.
Figure 19:
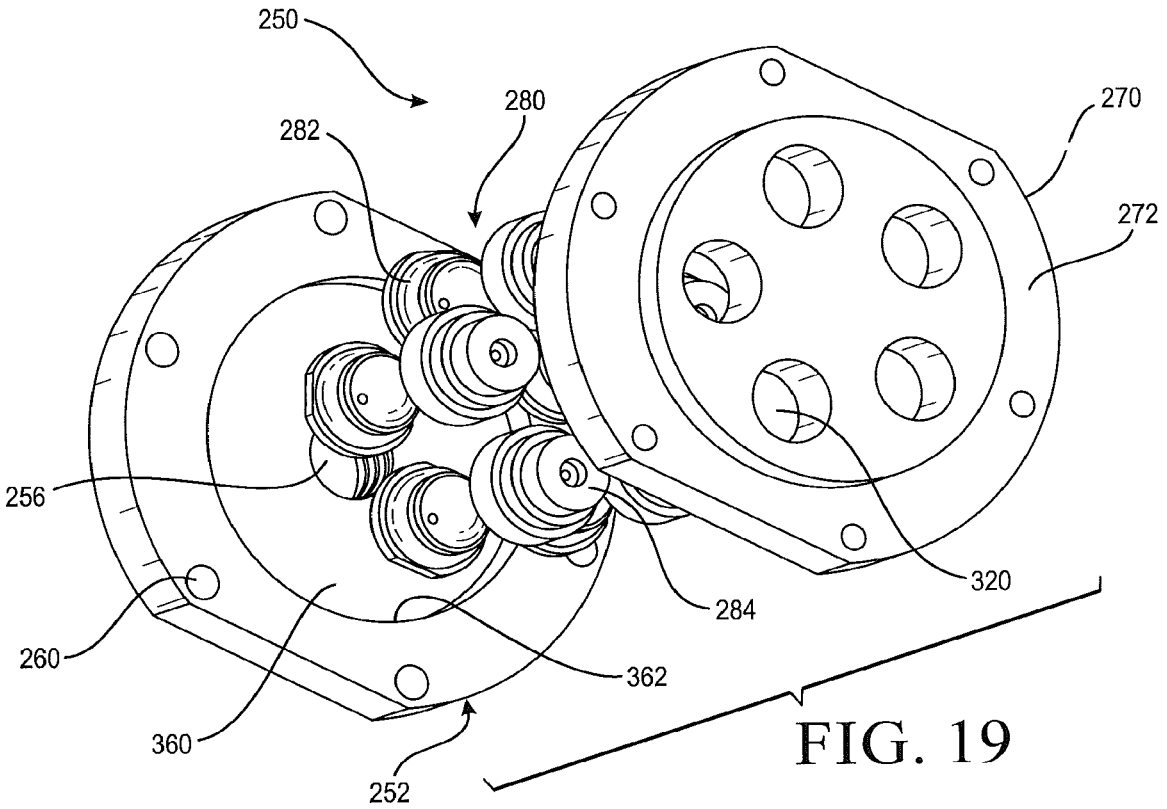
FIG. 19 is an exploded bottom perspective view of the embodiment of FIG. 18, illustrating from left to right in the Figure top and bottom housing and internal components.

FIGS. 18 and 19 illustrate exploded top and bottom perspective views of a third multiple fluidic oscillator scanner spray embodiment of the present invention, illustrating at 250 a fluidic oscillating scanner showerhead in accordance with the present invention. The showerhead incorporates a top (or rear) housing component 252 having an upper surface 254 in which is located an inlet fixture 256 that in this case is internally threaded, as at 258, for connection to a suitable hose or pipe fitting to receive fluid under pressure. The inlet fixture is axially centered in the component 252 and passes through it to direct supplied fluid to an internal cavity, or plenum, formed within the showerhead assembly 250. Spaced around the edge of the rear component 252 are a plurality of apertures for receiving suitable fasteners for securing this component to a corresponding bottom (or front panel) showerhead component 270 having a front face surface 272 around which are spaced apertures 274 corresponding to the apertures 260 in the top housing component 252 to receive corresponding fasteners for assembling the showerhead. In this embodiment, the showerhead includes, for example, five two-part fluidic oscillator circuits 280 for producing an output scanner spray, in accordance with the invention.

Figure 20:
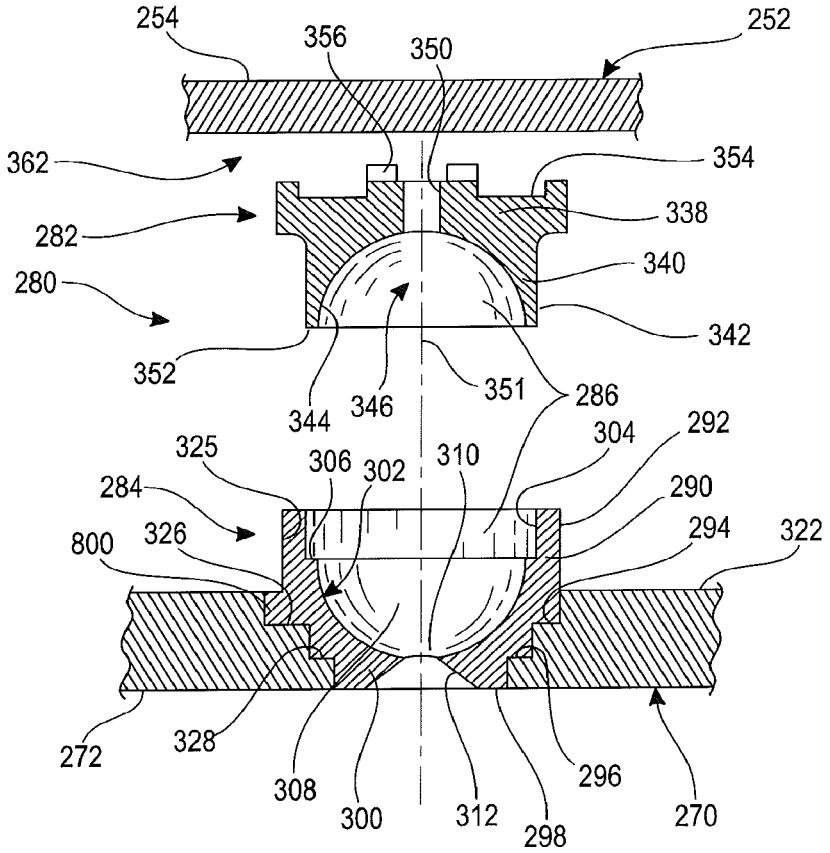
FIG. 20 is a diagrammatic, exploded cross-sectional view of a fluidic oscillator component of the device of FIGS. 18 and 19, in accordance with the present invention.

As illustrated in perspective views in FIGS. 18 and 19, and in cross-section in FIG. 20, a two-part fluidic oscillator 280 consists of upper and lower insert portions, or halves 282 and 284 which are separately fabricated, as by molding, and which fit together to produce a substantially spherical interaction region generally indicated at 286 in FIG. 20. The lower insert 284 includes a side wall 290 having a generally cylindrical exterior surface 292 which is stepped downwardly and inwardly to form a pair of steps 294 and 296 and a bottom wall 300. The inner surface 302 of the insert portion 284 has an upper cylindrical portion 304, an inwardly extending ledge 306, and a substantially hemispherical, upwardly opening cavity 308. In the bottom wall 300 of the insert portion 284 is an outlet aperture 310 which opens downwardly and outwardly from the cavity 308 through a tapered, expanding throat 312.

The several lower insert portions 284 are received in corresponding openings or receptacles 320 in the front showerhead component, or front plate 270, best seen in FIGS. 18 and 19. As illustrated, in this embodiment five receptacles are equally spaced around the front plate to receive five inserts, although it will be understood that they need not be equally spaced. On the rearward, or inner surface 322 of plate 270 it will be seen that the receptacles are spaced radially inwardly of a circumferential sealing groove 324 adapted to receive a suitable sealing gasket (not shown) for providing a fluid-tight seal when the showerhead 250 is assembled. Also, as seen in FIG. 18, and illustrated in the cross-section of FIG. 20, each receptacle 320 has a cylindrical upper wall 325 and incorporates below that upper wall 325 inwardly extending steps, or ledges 326 and 328 shaped so that the receptacle receives the corresponding exterior wall 292 and steps 294 and 296 of the lower insert portion 284, with each receptacle snugly securing a corresponding insert.

The upper portion 282 of the two-part fluidic oscillator 280 includes a top wall 338 and a depending sidewall 340 having a cylindrical outer surface 342 having an outer diameter which is snugly received in the upper cylindrical wall 304 of insert portion 284 upon assembly of the oscillator. The inner surface 344 of sidewall 340 forms a downwardly opening hemispherical dome 346, the upper portion of which is formed in the top wall 338 of upper portion 282 of the two-part insert, as illustrated in FIG. 20. A fluid inlet aperture, or power nozzle 350 having an axis 351 extends through the top wall 338 to admit fluid under pressure into the substantially spherical interior interaction region 286 of the oscillator 280. The spherical interaction chamber is formed when the upper insert portion 282 is joined to the lower insert portion 284 by pressing the two halves together so that the surface 342 is in contact with the surface 304 and the bottom 352 of portion 282 engages ledge 306 of portion 284. To assist in the assembly of the device, the top surface 354 of each fluidic oscillator assembly 280 incorporates three spaced, upstanding spacer posts 356 (see FIG. 18) which engage the undersurface 360 (see FIG. 19) of the rear showerhead component 252 when the showerhead is assembled, to force the insert halves together and into their corresponding receptacles 320.

When so assembled, fluid under pressure enters the showerhead 250 via inlet 256 into a plenum 362 formed between the top and bottom components 252 and 270, and in which the upper portions of the fluidic oscillators are located. The fluid circulates in plenum 362 and flows between the upstanding spacer posts 356 into the power nozzle inlets 350 of each oscillator and into the spherical interaction region 286. The spacer posts not only position the oscillators in the housing, but also act as turbulence filters to calm any turbulence in the plenum and to smooth the fluid flow into the fluidic oscillator power nozzles. The fluid flow into the spherical fluidic oscillator generates fluidic oscillations which, in turn, produce a fluid discharge from the region 286 through aperture 310 and throat 312 into ambient atmosphere to produce the conical scanner spray discussed above. As in the previously-described embodiments, the spray outputs from outlet apertures 310 and throats 312 are configured by selectively offsetting them from the axes 351 of their corresponding power nozzles in each of the fluidic oscillators to permit preselected scanner spray patterns for the spray device 250.

FIGS. 21-25 illustrate at 400 a fourth embodiment of the scanner sprayer of the present invention incorporating multiple fluidic oscillators wherein downstream (or front) halves of the oscillator interaction regions, including outlet apertures and throats, are all molded in one piece of the sprayer and upstream (or rear) halves of the oscillator including power nozzles and upstream halves of the interaction regions are molded in one other piece of the sprayer to simplify its manufacture and assembly. In this embodiment, the scanner sprayer 400, which is illustrated as a showerhead having multiple spray outlet streams, includes a rear (or upper as viewed in FIGS. 21 and 22) cup-shaped housing member 402 having a top wall 404 and a forwardly (downwardly as viewed in FIGS. 21 and 22) extending, generally cylindrical side wall 406 having an inward peripheral shoulder 407. Centrally located in the top wall 402 is an upstanding fluid inlet fixture 408 having a cylindrical side wall 410 carrying external threads 412 for receiving a suitable internally and externally threaded fluid supply fitting 414. The fitting 414 may be any conventional supply fitting, with the illustrated device having a generally cylindrical wall 420 incorporating at its lower end 422 suitable internal threads 424 for engaging the threads 412, and incorporating at its upper end 426 external threads 428 for receiving a threaded fluid supply hose or pipe, or the like (not shown). The fitting 414 may include an internal nozzle 430 secured at its lower end 432 in the upper wall portion 426 of fitting 414 and engaging a cylindrical seal 433 in the inlet fixture 408, and having an upper connector portion 434 for receiving a supply fluid. The internal nozzle includes an outlet aperture 436 for directing fluid into an internal plenum 440 defined within the cup-shaped housing member 402.

The undersurface 450 of wall 404 of the housing member 402 includes a plurality of spaced, arcuate reinforcing ridges 452 spaced inwardly from side wall 406 to provide reinforcement for wall 404 and to act as spacers for positioning a lower, or face plate portion 454 of the scanner sprayer 400 within the plenum region 440. In addition, the ridges provide sufficient strength to receive a plurality of spaced fastener holes 456. Corresponding fastener holes 458 are provided in the face plate 454 and may be threaded, as at 460 to receive a suitable fastener such as a threaded bolt for assembly of the scanner sprayer 400.

The front plate 454 incorporates a three-tier, layered fluidic oscillator assembly forming multiple, two-part spaced fluidic oscillators to produce scanning sprays such as those described above in the previous embodiments. The front plate 454 includes a lowermost (as viewed in FIGS. 21 and 22) layer that is a supporting frontpiece 470, which supports a middle layer plate 472. The middle layer is molded to form the first parts of all of the oscillators, that is, the downstream (or front) halves 474 of the multiple fluidic oscillator interaction regions of this device. The middle layer in turn supports an uppermost layer, or top plate 476 that is molded to form the second parts of all of the oscillators, that is, the upstream (or back) halves 478 of the multiple fluidic oscillator interaction regions. Since these layers are each typically made by plastic injection molding methods, those knowledgeable with such manufacturing methods will understand that such manufacturing methods impose some constraints on the geometry of such inserts and their enclosures, so the described embodiment is illustrative of the invention. To facilitate the alignment of a large number of fluidic oscillators in the assembly 454, one of the upper 476 or middle 472 layers may be molded out of a flexible material to allow it to conform to the other hard plastic layer. Alternatively, to facilitate the alignment of a large number of fluidic oscillators in the assembly and to allow bending of the fluidics into various aim angles, both the upper 476 and middle 472 layers may be molded out of a flexible material to allow them to conform to each other and the lower layer 470 may be a hard plastic forming a hard face or backing plate that holds prescribed aim angles.

Figure 21:
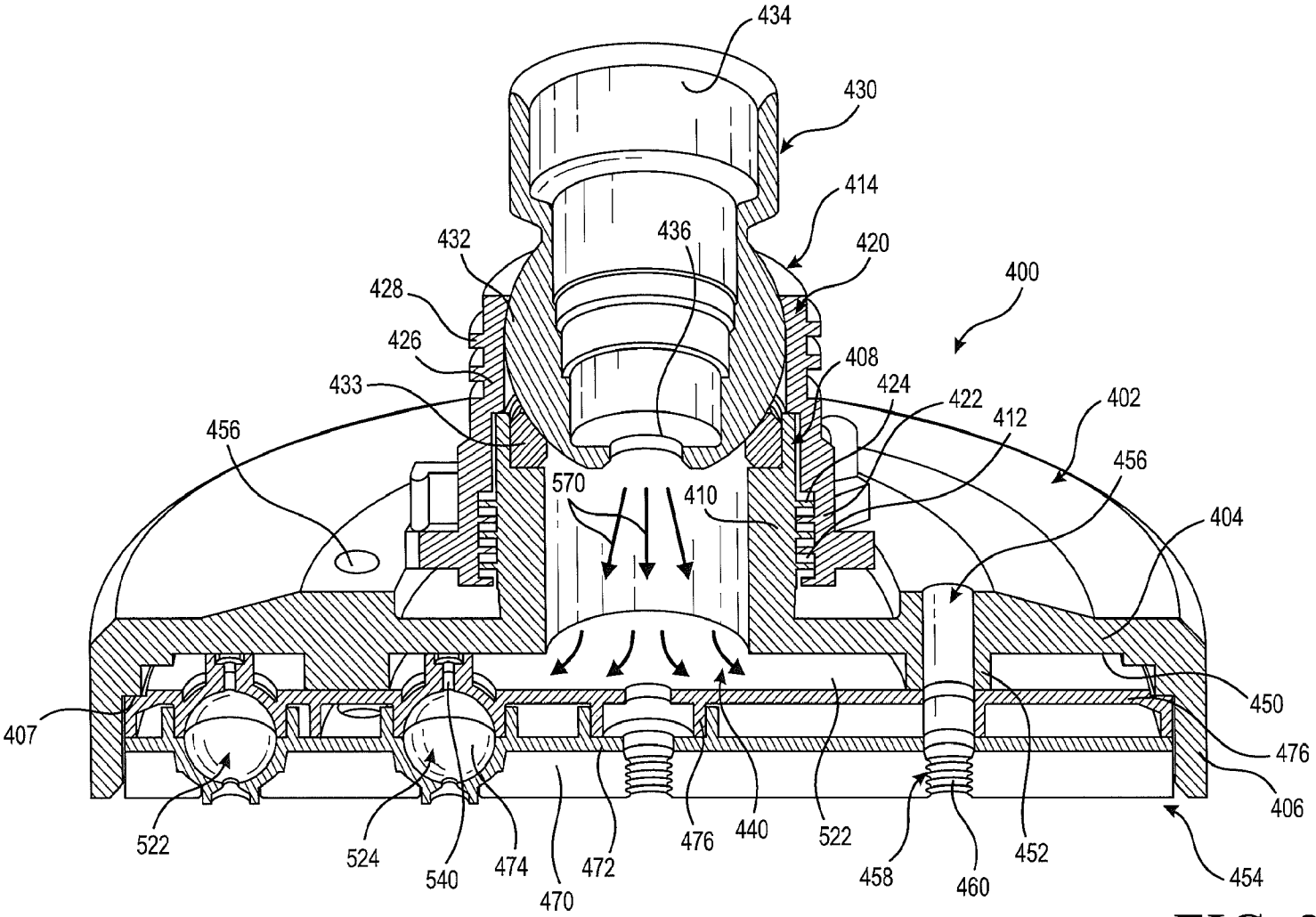
FIG. 21 is a top perspective cross-sectional view of a fourth embodiment of the scanning showerhead of the present invention, illustrating the configuration of fluidic oscillator chambers in the showerhead assembly.
Figure 22:
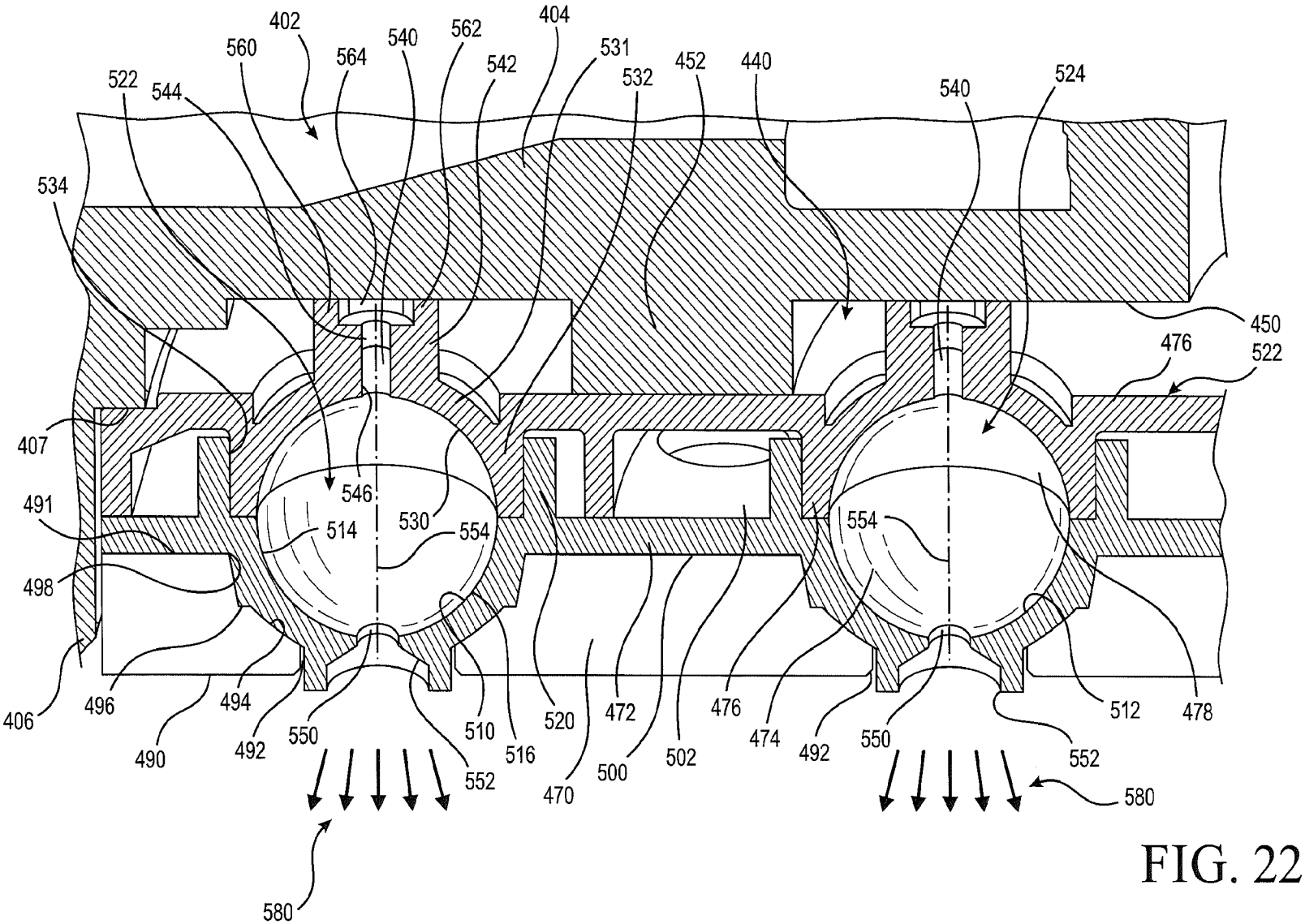
FIG. 22 is an enlarged view of a portion of FIG. 21.
Figure 23:
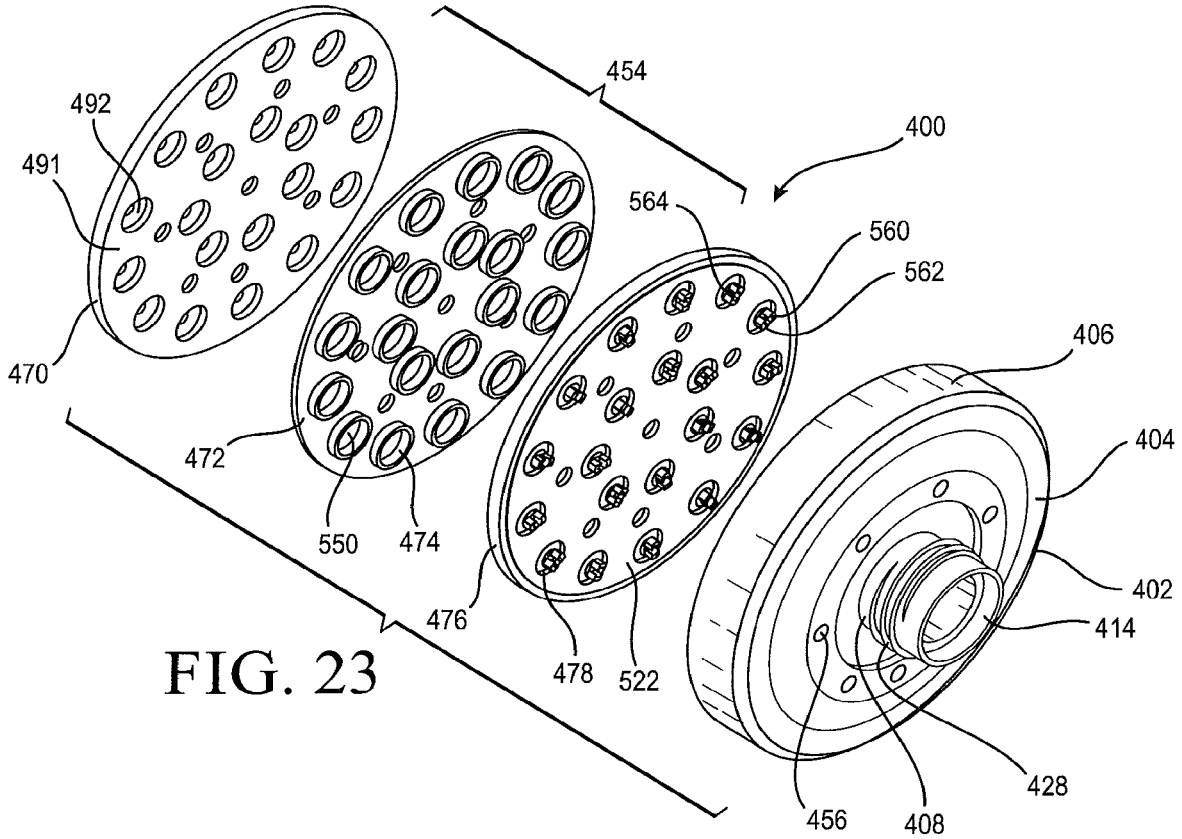
FIG. 23 is a top perspective exploded view of the device of FIG. 21.
Figure 24:
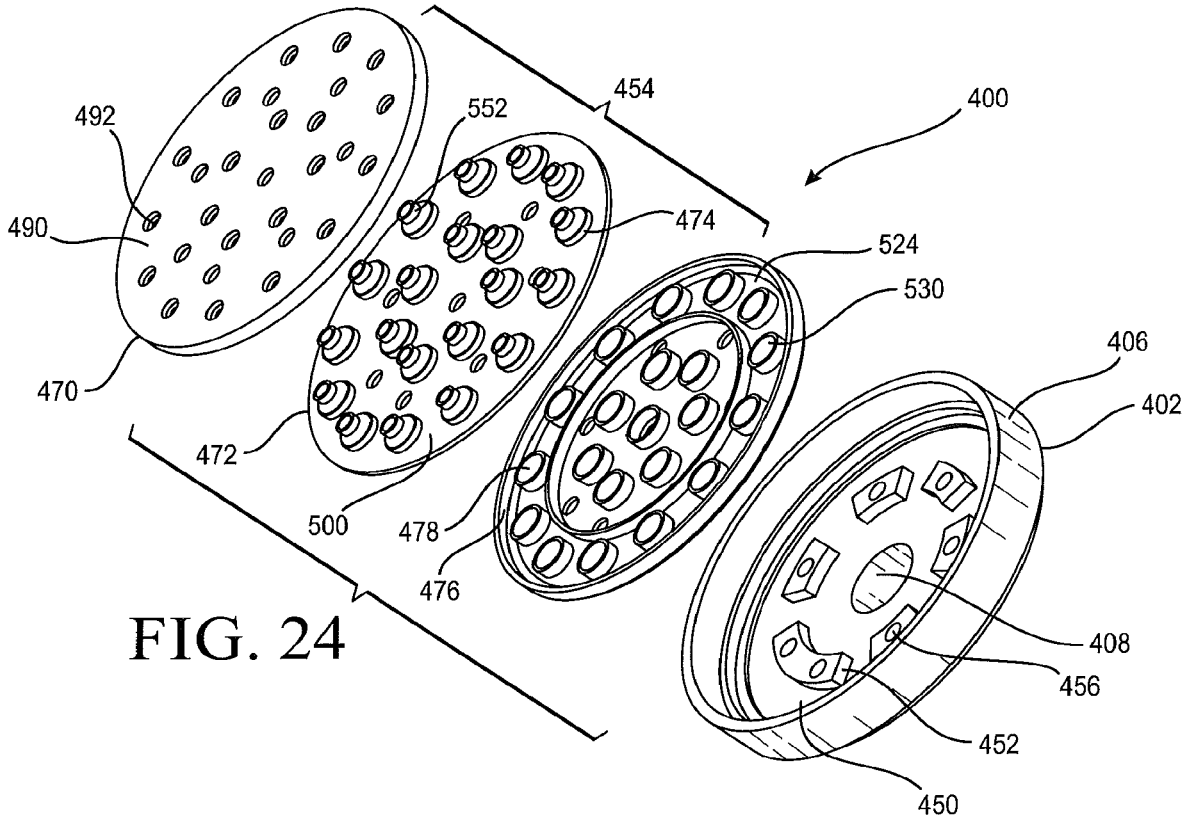
FIG. 24 is a bottom perspective exploded view of the device of FIG. 21.
Figure 25:
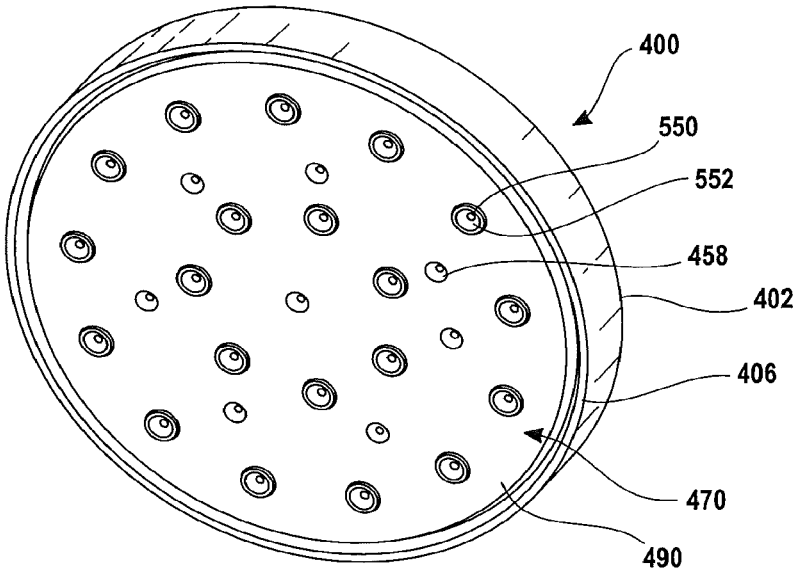
FIG. 25 is a bottom perspective view of the device of FIG. 21, in accordance with the present invention.

As illustrated, the lowermost layer 470 has a front surface 490 which serves as the visible face of the sprayer (see FIG. 25) and a substantially planar back surface 491 (see FIG. 23) which is in contact with the middle layer 472 (see FIGS. 21 and 22). Lower layer 470 incorporates a plurality of spray fluidics outlets 492 which are spaced around the scanner sprayer 400 in a desired pattern with the number of such outlets depending on the number of spray outputs desired for the scanner sprayer 400. In the illustrated embodiment 20 such outputs are included, each substantially the same as those illustrated in cross-section in FIGS. 21 and 22. Each outlet 492 has a wall 494 that is tapered upwardly and outwardly, and is shaped to receive corresponding downstream fluidic oscillator components 474 formed by the middle layer 472, with the wall including a shoulder 496 for positioning the downstream oscillator components, and a top surface aperture 498 into which the downstream oscillator components are inserted in the assembly of the front plate 454. The lowermost layer also incorporates the fastener openings 458 described above.

Middle layer 472 is generally planar, having a bottom face 500 shaped to contact face 491 of the lowermost layer 470, and having a top face 502 generally parallel to it. The middle layer incorporates a plurality of depressions, two of which are illustrated in FIGS. 21 and 22 at 510 and 512, with the number of depressions matching in number and location the number of front plate outlets 492. Each depression has an inner surface 514 that is generally hemispherical and an outer surface 516 that is shaped to match the shape of its corresponding opening in the lowermost plate 470 and forms the downstream component 474 of a fluidic oscillator. A generally cylindrical upstanding wall 520 surrounds each depression and is positioned to receive and position the upper layer 476.

The upper layer 476 of the front plate 470 is generally planar, with an upper surface 522 and a lower, generally parallel surface 524, and incorporates a plurality of hemispherical domes 530 shaped by top curved walls 531 and downwardly extending side walls 532 and forming the upstream component 478 of a fluidic oscillator. The outer surfaces 534 of side walls 532 are generally cylindrical and fit into corresponding lowermost layer cylindrical walls 520, when the front plate 454 is assembled, to produce generally spherical fluidic oscillator interaction regions, two of which are illustrated in the Figures at 522 and 524. The top walls 531 incorporate centrally-located power nozzles 540 surrounded by upstanding cylindrical walls 542 and having upper ends 544 which open into the plenum 440 and lower ends 546 which open into the fluidic oscillator interaction regions, such as those illustrated at 522 and 524.

Opposite the power nozzles 540 in each fluidic oscillator and located in the approximate center of the downstream hemispherical surface 514 is an outlet aperture 550 which opens into ambient by way of a downwardly and outwardly opening throat 552 which is shaped to produce desired fluid scanning spray characteristics. As in prior embodiments of the invention, the outlet apertures 550 are offset from the axes 554 (see FIG. 22) of the corresponding power nozzles by selected amounts, again to produce desired fluidic oscillation in the interaction chambers and to produce desired spray scanning characteristics.

On the top surface of each power nozzle side wall 542 are spacer posts, such as posts 560 and 562 illustrated in FIGS. 21 and 22, which extend upwardly to engage the undersurface 450 of the upper housing component 402 when the device is assembled. If desired each oscillator may include three spaced posts, as illustrated in the embodiment of FIG. 18. Between the posts are spaced openings 564 leading from the plenum to the power nozzle. These posts also serve as filters for the fluid in the plenum to reduce fluid turbulence in the inlets to the power nozzles.

Assembly of the scanner sprayer 400 is easily done. After the parts have been molded, the three layers of the front plate 454 are aligned (see FIGS. 23 and 24) so that they may be pressed together with the depressions 510, 512 of the middle layer 472 fitting snugly into the corresponding openings 492 in the bottom layer 470, and with the downwardly-extending walls 532 of the upper layer 476 fitting snugly into the upwardly-extending walls 520 of the middle layer 472. When pressed together, these three layers form the composite, or layered front plate 454 incorporating a plurality of fluidic oscillators having downstream, forwardly facing (downwardly in the views of FIGS. 21 and 22) outlet apertures 550. The front plate 454 is then inserted into the front-facing cavity formed by the cup-shaped rear (or upper) housing 402 and the entire assembly is pressed together and secured by fasteners through apertures 456. Pressing the assembly together pulls the front plate inwardly into contact with the interior peripheral shoulder 407 of the side wall 406 of the upper housing 402 and the downwardly-extending ridges 452 so that the front plate and rear housing are spaced apart sufficiently to form the housing plenum 440. Spacers 452 also engage the under surface 450 of the top housing component 402 to space the front plate from the top housing, with the spaces 464 between the spacers 462 providing fluid communication between the plenum and the oscillator power nozzles.

In operation, fluid under pressure, indicated by arrows 570, is supplied to the sprayer 400 through inlet 436 and flows downwardly through inlet 410 into the plenum 440 and flows outwardly toward the fluidic oscillators. The fluid 570 enters the fluidic oscillators from the plenum by way of the spaces 564 between the spacer posts 560, 562 and thus into the power nozzles 540 and the spherical interaction regions 522 and 524, as best seen in FIG. 22. The fluid circulates in the interaction region to generate fluidic oscillations and is ejected through each outlet aperture 550 and throat 552 as a conical scanning spray 580 having a direction and conical angle as predetermined by the design of the individual fluidic oscillator.

As has been discussed above, for example in the description of the outlet apertures 158 and the throats 160 in the embodiment of FIGS. 7-9, the apertures 208 and throat 210 in the embodiment of FIGS. 10-17, the apertures 310 and throat 312 in the embodiment of FIGS. 18-20, and the apertures 550 and 552 of the embodiment of FIGS. 21-25, the outlet apertures of each fluidic oscillator are offset radially from the axes of the corresponding opposed power nozzles. These outlets are formed in the bottom surface of each fluidic oscillator, and with the exception of the embodiment of FIGS. 18-20, are all molded in preselected locations and with preselected offsets in a single front plate incorporating multiple outlets. The configurations of these outlets, and the downstream throats, of selected, usually different, dimensions and angles to provide predetermined different but complementary outlet spray patterns for each oscillator output scanner spray. The offset of each fluidic oscillator may be in any direction from the corresponding power nozzle axis, and the offsets may all be the same, or a selected mixture of offset amounts, or there may be no offsets, as with each individual oscillator configured to produce a selected spray cone direction and angle, with all of them being selected to produce a desired overall, or composite, scanner spray pattern. The embodiment of FIGS. 18-20 differs in that the lower parts of the fluidic oscillator are each fabricated separately and are inserted in in a supporting faceplate 270; however, as illustrated in FIG. 20, each may incorporate similar aperture and throat configurations having selected offsets from their corresponding power nozzle axes.

FIGS. 26-33A illustrate in diagrammatic form a method for fabricating selected fluidic oscillator configurations that may be used with scanner sprayers of the present invention. For convenience, these illustrations are provided for the fluidic oscillator configuration of the embodiment of FIGS.

Figure 26:
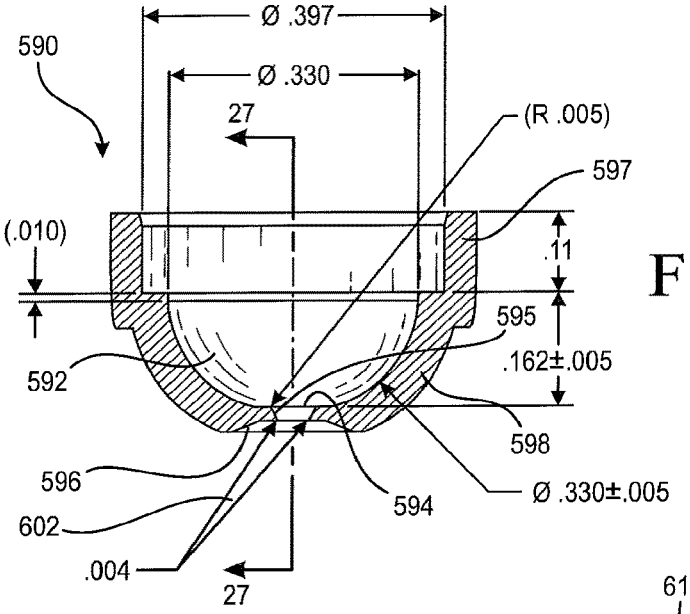
FIG. 26 is a diagrammatic cross-sectional view of a first version of a fluidic oscillator chamber, or interaction region, and its outlet aperture and throat configuration, in accordance with the present invention.

18-20, but it will be apparent that the same configurations may be incorporated in the rest of the described embodiments. Further, these Figures include dimensions for a preferred embodiment of the invention, to better illustrate its features. Thus, FIG. 26 is a diagrammatic cross-sectional view of a first version of a lower portion 590 of a fluidic oscillator insert that forms a lower half of a hemispherical chamber, or interaction region 592, and which incorporates an outlet aperture 594 opening out of the interaction region 592 into an upper throat 595 and a lower throat 596, in accordance with the present invention. This part 590 of the oscillator corresponds to the similar insert lower half 284 of the device of FIGS. 18-20 and thus includes an upstanding cylindrical wall 597 and a hemispherical wall 598 adapted to fit into, and be supported by, a front plate (not shown) such as the plate 270 illustrated in FIG. 20.

Figure 27:
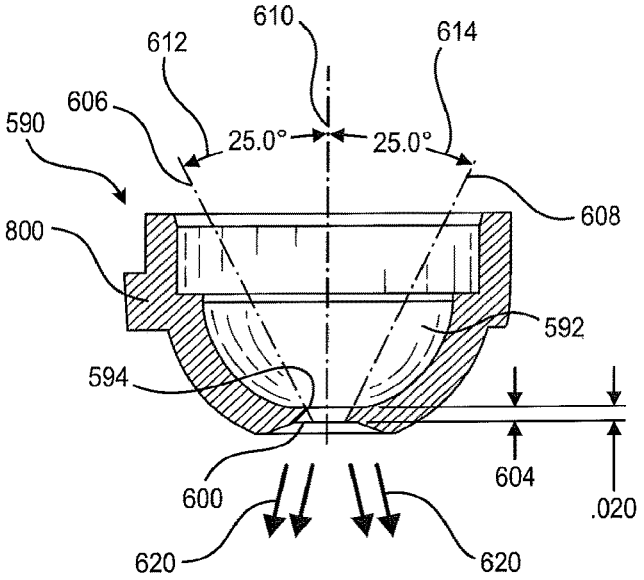
FIG. 27 is a cross-sectional view taken along line 27-27 of FIG. 26.
Figure 27A:
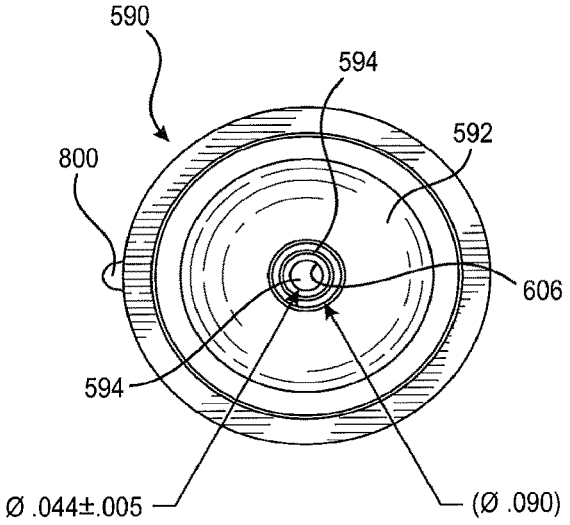
FIG. 27A is a top plan view of the device of FIG. 27.

FIG. 27 is a cross-sectional view of the insert 590, taken along line 27-27 of FIG. 26 and FIG. 27A is a top plan view of the device of FIG. 27. As illustrated, the outlet aperture 594 opens into the upper throat portion 595 which tapers downwardly and inwardly from the interaction region through opening 600, indicated by arrows 602 in FIG. 26, to define an upper throat length 604. The upper throat opens through the downwardly and outwardly tapered throat portion 596 to ambient. The taper angle of the upper throat portion 595 is indicated by the angle lines 606 and 608 which are extensions of the wall of the upper throat and pass through the edges of opening 600 and aperture 594 on opposite sides of a central axis 610. This axis passes through the centers of circular aperture 594 and circular opening 600, and when inlet 590 is assembled in a sprayer such as that of FIGS. 18-20, is also the axis of the oscillator power nozzle. In this version of the insert 590, both the angle 612 between extension 606 and axis 610 and the angle 614 between extension 608 and axis 610 are selected to be 25°, and this equality of throat angles produces no offset of the outlet with respect to the central axis of the interaction region. These equal upper throat angles cause the insert 590 produce a first outlet spray pattern indicated by outlet spray arrows, this first output fluidic spray having a first selected, predetermined outlet axis and cone angle, in accordance with the invention.

Figure 28:
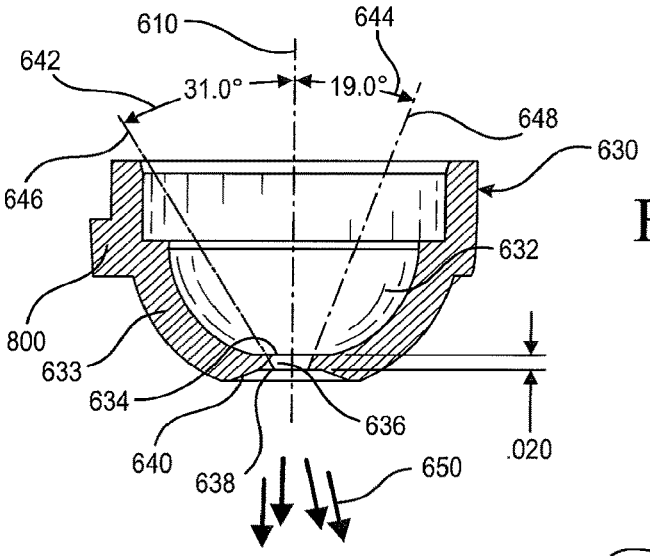
FIG. 28 is a diagrammatic cross-sectional view of a second version of a fluidic oscillator chamber, or interaction region, and its outlet aperture and throat configuration, in accordance with the present invention.
Figure 28A:
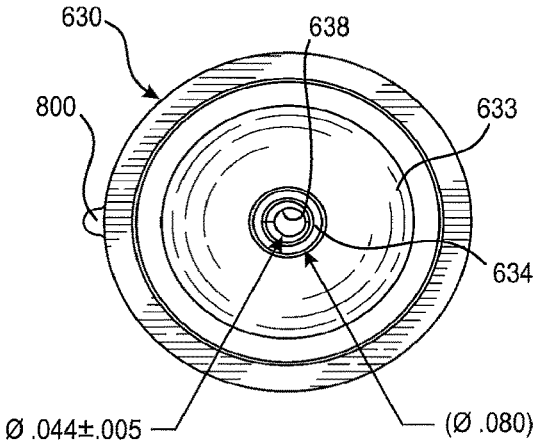
FIG. 28A is a top plan view of the device of FIG. 28.

FIG. 28 is a diagrammatic cross-sectional view, also taken at lines 27-27 of FIG. 26, of a second version 630 of a fluidic oscillator insert having an interaction region 632 defined by hemispherical wall 633. A circular outlet aperture 634 leads to a downwardly and outwardly tapering upper throat portion 636 which opens through a circular throat opening 638 into a downwardly and outwardly opening lower throat portion 640. In this version, the taper angles 642 and 644 of the upper throat portion differ on opposite sides of the central axis 610 (of the opposed power nozzle, not shown), as viewed in FIG. 27, with one half 642 of the throat having a wall angle of 31°, as illustrated by wall extension 646, and the other half 644 having an angle of 19°, as indicated by wall extension 648. The angle 642 of the throat wall at one side of the axis causes the base of the wall at opening 638 to shift closer to the axis, while the angle 644 of the wall at the other side shifts the opening away from the axis, thereby shifting, or offsetting, the opening 638 with respect to the axis and making the opening smaller, as illustrated in FIG. 28A. This configuration, in accordance with the present invention, effectively offsets the outlet throat from the axis 610 of the interaction chamber 602 to produce an outlet spray pattern, indicated by arrows 650, having a second predetermined outlet axis and cone angle. FIG. 28A is a top plan view of the device of FIG. 28, and illustrates the throat offset.

Figure 29:
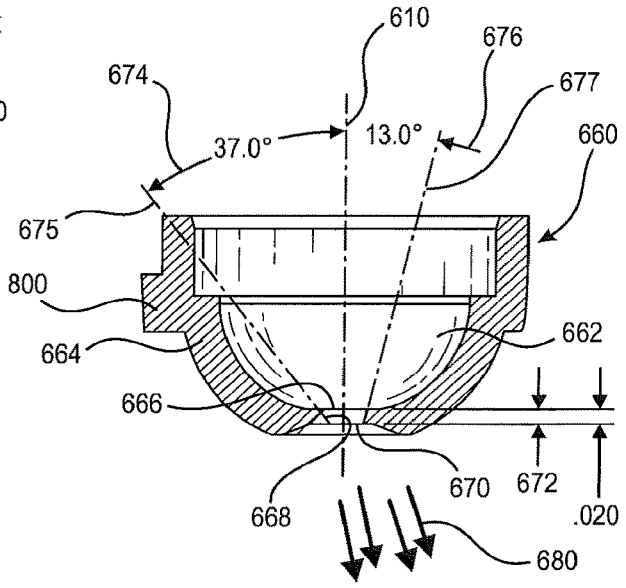
FIG. 29 is a diagrammatic cross-sectional view of a third version of a fluidic oscillator chamber, or interaction region, and its outlet aperture and throat configuration, in accordance with the present invention.
Figure 29A:
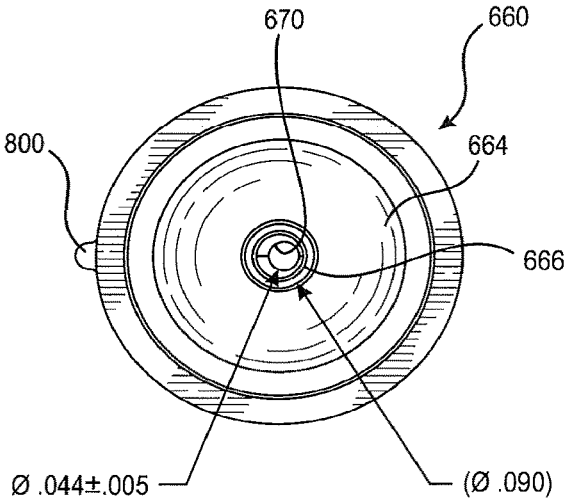
FIG. 29A is a top plan view of the device of FIG. 29.

Similarly, FIG. 29 is a diagrammatic cross-sectional view taken at lines 27-27 of FIG. 26, and illustrates a third version 660 of a fluidic oscillator chamber, or interaction region 662 formed by hemispherical wall 664 and having an outlet aperture 666, and an inwardly upper tapered throat wall 668 leading to opening 670. The upper part of the throat has a length 672 and is outwardly tapered at angle 674, illustrated in the Figure on the left side of axis 610 by extension 675 at an angle of 37° and at an angle 676, illustrated on the other side of the central axis by extension 677 at an angle of 13°. As explained with respect to FIG. 28, this angle difference shifts the opening 670 closer to the axis 610 with respect to the aperture 666 to produce a larger offset than that of FIG. 28, as illustrated in FIG. 29A, and to make the opening 670 slightly smaller to produce an outlet fluidic spray indicated by arrows 680 having a third predetermined outlet axis and cone angle.

Figure 30:
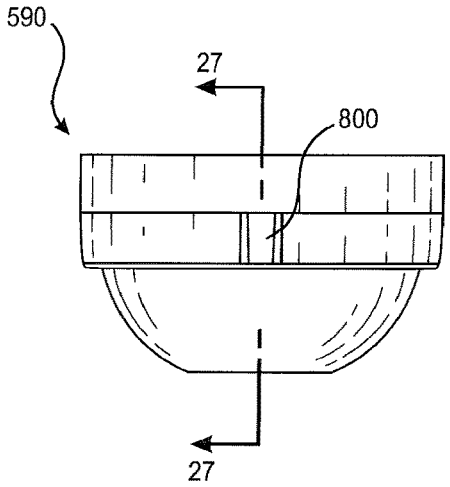
FIG. 30 is a diagrammatic side elevation view of the device of FIG. 26.
Figure 31:
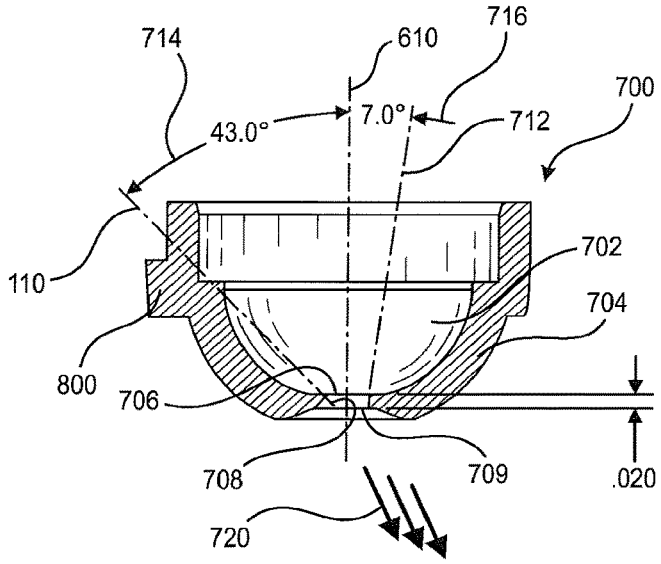
FIG. 31 is a diagrammatic cross-sectional view taken along line 31-31 of FIG. 30 and illustrating a fourth version of a fluidic oscillator chamber, or interaction region, and its outlet aperture and throat configuration, in accordance with the present invention.
Figure 31A:
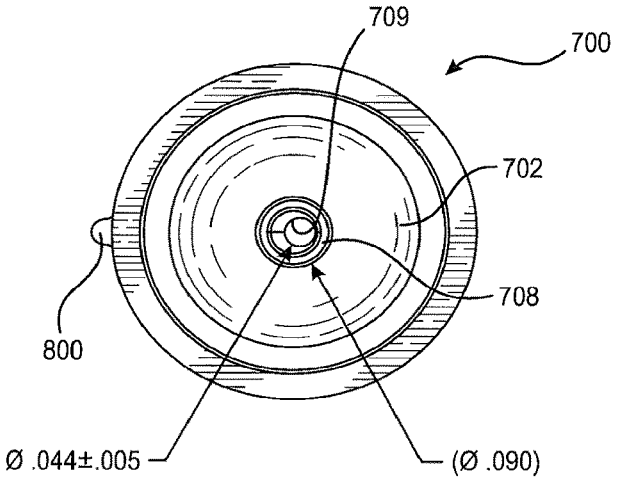
FIG. 31A is a top plan view of the scanner throat of FIG. 31.

FIG. 30 is a diagrammatic side elevation view of the device 590 of FIG. 26, while FIG. 31 is a diagrammatic cross-sectional view taken along line 27-27 of FIGS. 26 and 30, illustrating a fourth version 700 of a fluidic oscillator unit. This unit has an interaction region 702 defined by a hemispheric wall 704 having an outlet aperture 706 leading to an upper throat 708 having a lower opening 709, configured as described above. As illustrated, the upper throat 708 has a wall that is inwardly tapered, as indicated by wall angle extensions 710 and 712. One part of the throat wall, illustrated in the Figure on the left side of its axis 610, is at an angle 714 of 43° and the other part, illustrated on the other side of the central axis, is at an angle 716 of 7°. This produces a larger offset of opening 709 at the bottom of throat 708, with respect to the axis and to the aperture 706 than that of FIG. 28, as illustrated FIG. 31A, which is a top plan view of the device of FIG. 31. This configuration produces an outlet spray pattern having a fourth predetermined outlet axis and cone angle, as indicated by arrows 720, in accordance with the present invention.

Figure 32:
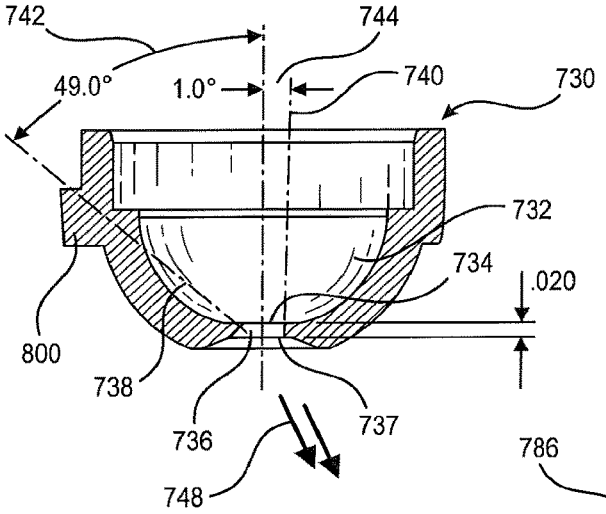
FIG. 32 is a diagrammatic cross-sectional view of a fifth version of a fluidic oscillator chamber, or interaction region, and its outlet aperture and throat configuration, in accordance with the present invention.
Figure 32A:
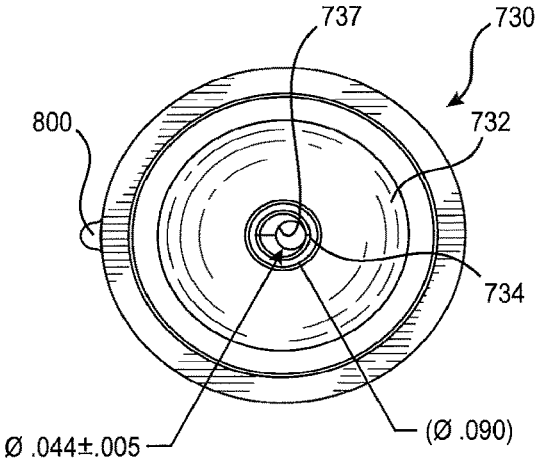
FIG. 32A is a top plan view of the scanner throat of FIG. 32.
Figure 33A:
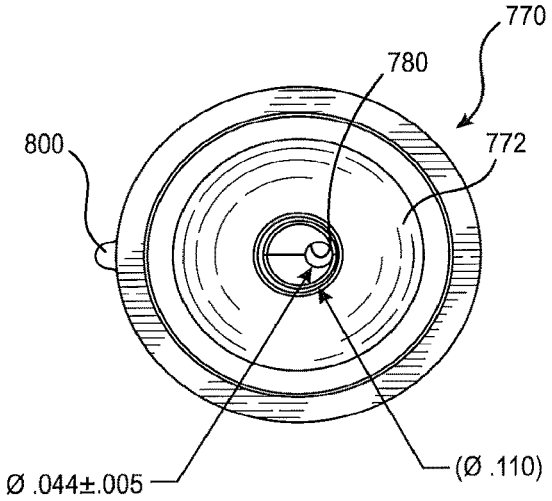
FIG. 33A is a top plan view of the scanner throat of FIG. 33, in accordance with the present invention.

FIG. 32 is a diagrammatic cross-sectional view, taken at 27-27 of FIG. 26, of a fifth version 730 of an inset having a fluidic oscillator chamber, or interaction region 732, and an outlet aperture 734 leading to an upper throat 736 configuration which has a lower opening 737, in accordance with the present invention. The upper part of throat 736 has a wall that is downwardly and inwardly tapered, as indicated by wall angle extensions 738 and 740, with one part of the wall, illustrated in the Figure by extension 738 on the left side of its axis 610, at an angle 742 of 49°, and the other part, illustrated on the other (right) side of the central axis 610 at an angle 744 of 1°. This provides a larger offset of the opening 737 with respect to the axis 610 and the aperture 734, and an opening that is smaller than those of the prior versions discussed above, as best seen in FIG. 32A, which is a top plan view of the device of FIG. 32. This configuration produces an outlet spray pattern, illustrated by arrows 748, having a fifth predetermined outlet axis and cone angle in accordance with the present invention.

Figure 33:
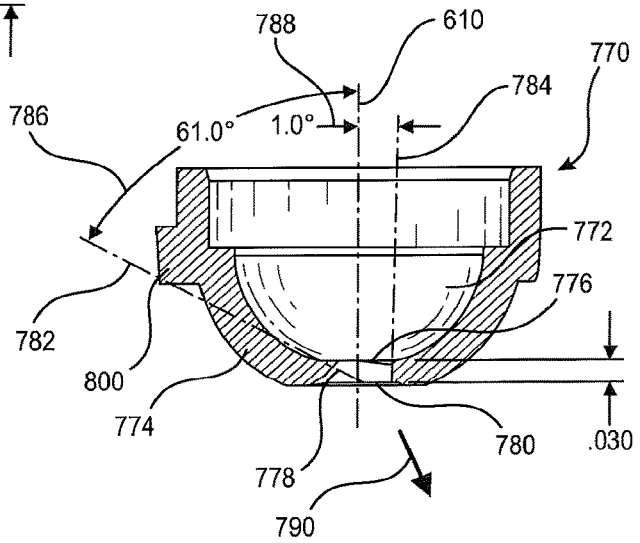
FIG. 33 is a diagrammatic cross-sectional view of a sixth version of a fluidic oscillator chamber, or interaction region, and its outlet aperture and throat configuration, in accordance with the present invention.

FIG. 33 is a diagrammatic cross-sectional view, taken at 27-27 of FIG. 26, of a sixth version 770 of a sprayer insert including a fluidic oscillator chamber, or interaction region 772 defined by a hemispherical wall 774. The interaction region incorporates an outlet aperture 776 which leads through an upper throat 778 to an outlet opening 780, in accordance with the present invention. The upper throat 778 is downwardly and inwardly tapered, as indicated by wall angle extensions 782 and 784, with one part of the wall, illustrated in the Figure by extension 782 on the left side of its axis 610, at an angle 786 of 61°, and the other part, illustrated on the other (right) side of the central axis 610 at an angle 788 of 1°. This provides a larger offset of the opening 780 with respect to the axis 610 and the aperture 776, and an opening that is smaller than those of the prior versions discussed above, as best seen in FIG. 33A, which is a top plan view of the device of FIG. 33, to produce an outlet spray pattern 790 having a fifth predetermined outlet axis and cone angle in accordance with the present invention.

It will be noted that each of the described fluidic oscillator inserts described in FIGS. 26-33A incorporates a protrusion 800 which serves as an alignment tab for aligning the insert with a support front plate in a sprayer. As indicated, the tabs are aligned with the direction of offset, and thus serve to identify the direction of the spray outlet for the corresponding insert. FIGS. 18 and 20 illustrate the use of the inserts of FIGS. 26-33A in a sprayer device, where each of the lower halves of the inserts 280 incorporate an alignment tab 800, while each opening 320 in the front plate 270 has an alignment notch 802 to receive a tab. The alignment notches are placed at predetermined locations around the circumferences of the openings 320. Since each of the inserts 590, 630 700 730 and 770 is configured to produce a different, known scanning spray characteristic; i.e. a known spray cone angle and direction as produced by the specific outlet offset, and since the locations of the notches are predetermined in the front plate, selection of any insert for any front plate opening allows provision of a desired combined spray pattern from the sprayer, which is a composite of all the selected individual spray inserts. Each of the inserts provides a scanning output within its cone, so that in accordance with the invention highly desirable scanning sprayers are provided The variations in the outlet throat offset described in FIGS. 26-33A illustrate the manner in which 3-dimensional scanning fluidic outputs, each providing a spray output that sweeps, or scans in a preselected, conical pattern size and direction, can be varied by changing the characteristics of the outlet throat angle and thus its location with respect to a fluidic oscillator interaction region axis which coincides with the axis of the opposed input power nozzle. These Figures illustrate typical measurements for fluidic oscillators in which vortices are produced to generate a scanning spray output having droplets of selected size and velocity, for use in scanner spray devices as disclosed herein to produce preselected spray patterns for scanning spray devices. In particular, the devices of the invention are used in applications such as scanner body sprays and showerheads to generate fluidic oscillator spray outputs which deliver a multiplicity of sprays having selected cone angles and directions. In the scanner fluidic showerhead assembly of the present invention, one fluidic scanner nozzle member effectively replaces 2-4 normal fluid jets by providing a small cone angle and uniform distribution, so that a scanner fluidic showerhead can have from 5-40 openings, which should overcome a possible objection (not enough openings) that may deter a consumer. In a typical prior fluidic showerhead, one fluidic replaces 10-15 jets, leaving a typical prior fluidic showerhead with 4-10 openings where a comparable jet type showerhead would have 40-100 openings.

Persons of skill in the art will appreciate that the present invention can be configured to provide a new scanner fluidic oscillator adapted or configurable for use in an economically manufactured fluidic showerhead or nozzle assembly (e.g., 50, 198, 250, 400) which aims oscillating sprays from multiple scanner fluidics to spread water uniformly over a preselected coverage area positioned distally from or in front of the front plate or front panel (56, 200, 270, 454). The scanner fluidics and showerhead of the present invention are configurable to provide a particular composite pleasing spray pattern with a selected, droplet size, droplet velocity, and temperature uniformity at very low flow rates (i.e., 2 gpm or less) for showering, washing or spraying a target area. The scanner fluidics are provided in a plurality of distinct configurations for generating individually tailored scanning sprays having a selected scanning spray characteristics. The showerhead's front plate (e.g., 56, 200, 270, 454) is configured to support and aim the fluidic oscillators, optionally with indexing slots 802 configured to receive corresponding angular indexing tabs 800 on the fluidic oscillator inserts to orient and aim the spray from each fluidic oscillator (e.g., 172, 220, 282, 530).

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A scanner sprayer device comprising:

a plurality of fluidic oscillators positioned in a housing, each fluidic oscillator comprising:

a hemispheric upper part of an interaction region having an inlet power nozzle; and a hemispheric lower part of the interaction region having a corresponding outlet aperture and throat;

the housing having a rear portion and a front panel forming an enclosed fluid plenum, wherein said hemispheric upper parts of each fluidic oscillator are in fluid communication with said fluid plenum by way of said inlet power nozzles which lead fluid into the interaction regions, wherein said outlet throats of said hemispheric lower parts are in fluid communication with an ambient environment by way of said outlet apertures and throats;

wherein the plurality of hemispheric upper parts of the plurality of fluidic oscillators are formed into a top plate to facilitate the alignment of the fluidic oscillators in the housing; and wherein the throats are configured to produce selected outlet scanning sprays each having a predetermined conical outlet spray having a selected width, wherein each spray is centered along a spray axis.

2. The scanner sprayer device of claim 1, wherein:

the throat of said hemispheric lower part of at least one fluidic oscillator opposes the inlet power nozzle of the hemispheric upper part and is selectively offset with respect to the axis of the opposed inlet power nozzle by the angle of the outlet throat.

3. The scanner sprayer of claim 1, wherein each fluidic oscillator has selected offsets to produce multiple outlet sprays from the housing, with each fluidic oscillator having selected output characteristics determined by the selection of desired offset combinations for producing a composite scanning spray pattern.

4. The scanner sprayer of claim 1, further including in said front panel at least one individual indexing feature or slot configured to receive a corresponding angular indexing feature or tab defined on at least one fluidic oscillator which orients and aims said fluidic oscillator and provides an azimuth angle orientation for said fluidic oscillator to provide an aimed fluidic oscillator spray having a selected angular offset of said aimed spray's individual spray axis from a normal angle to the front plate surface in a direction determined by said front plate's indexing feature or slot and said fluidic oscillator's indexing feature or tab.

5. A scanner sprayer device comprising:

a plurality of fluidic oscillators positioned in a housing, each fluidic oscillator comprising:

a hemispheric upper part of an interaction region having an inlet power nozzle;

a hemispheric lower part of the interaction region having a corresponding outlet aperture and throat;

the housing having a rear portion and a front panel forming an enclosed fluid plenum, wherein said hemispheric upper parts of each fluidic oscillator are in fluid communication with said fluid plenum by way of said inlet power nozzles which lead fluid into said interaction regions, wherein said outlet throats of said hemispheric lower parts are in fluid communication with an ambient environment by way of said outlet apertures and throats;

wherein the plurality of hemispheric lower parts of the plurality of fluidic oscillators are formed into a middle layer to facilitate the alignment of the fluidic oscillators in the housing; and wherein the throats are configured to produce a selected outlet scanning sprays each having a predetermined conical outlet spray having a selected width, wherein each spray is centered along a spray axis.

6. The scanner sprayer device of claim 5, wherein:

the throat of said hemispheric lower part of at least one fluidic oscillator opposes the inlet power nozzle of the hemispheric upper part and is selectively offset with respect to the axis of the inlet power nozzle by the angle of the outlet throat.

7. The scanner sprayer of claim 5, wherein each fluidic oscillator has selected offsets to produce multiple outlet sprays from the housing, with each fluidic oscillator having selected output characteristics determined by the selection of desired offset combinations for producing a composite scanning spray pattern.

8. A scanner sprayer device comprising:

a plurality of fluidic oscillators positioned in a housing, each fluidic oscillator comprising:

a hemispheric upper part of an interaction region having an inlet power nozzle; and a hemispheric lower part of the interaction region having a corresponding outlet aperture and throat, the throat of said hemispheric lower part opposes the inlet power nozzle of the hemispheric upper part and is selectively offset with respect to the axis of the opposed inlet power nozzle by the angle of the outlet throat;

the housing having a rear portion and a front panel forming an enclosed fluid plenum, wherein said hemispheric upper parts are in fluid communication with said fluid plenum by way of said inlet power nozzles which lead fluid into the interaction regions, and wherein said opposed outlet throats of said hemispheric lower parts are in fluid communication with an ambient environment by way of said outlet apertures and throats;

at least one individual indexing feature or slot in said front panel configured to receive a corresponding angular indexing feature or tab defined on at least one fluidic oscillator which orients and aims said fluidic oscillator and provides an azimuth angle orientation for said fluidic oscillator to provide an aimed fluidic oscillator spray having a selected angular offset of said aimed spray's individual spray axis from a normal angle to a front plate surface in a direction determined by said indexing feature or slot and said indexing feature or tab of said fluidic oscillator; and wherein the throats are configured to produce selected outlet scanning sprays each having a predetermined conical outlet spray having a selected width, wherein each spray is centered along a spray axis.

* * * * *